US010996616B1

(12) United States Patent
Kojima

(10) Patent No.: US 10,996,616 B1
(45) Date of Patent: May 4, 2021

(54) OPERATING MECHANISM AND IMAGE FORMING APPARATUS

(71) Applicant: TOSHIBA TEC KABUSHIKI KAISHA, Tokyo (JP)

(72) Inventor: Takahiro Kojima, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/828,828

(22) Filed: Mar. 24, 2020

(51) Int. Cl.
*G03G 21/16* (2006.01)
*G03G 15/04* (2006.01)

(52) U.S. Cl.
CPC ... *G03G 21/1647* (2013.01); *G03G 15/04036* (2013.01); *G03G 21/1666* (2013.01)

(58) Field of Classification Search
CPC ..... G03G 15/04036; G03G 21/1647; G03G 21/1666
See application file for complete search history.

(56) References Cited

U.S. PATENT DOCUMENTS 8,280,276 B2 * 10/2012 Sameshima ..... G03G 21/1671 399/110
9,283,788 B2 * 3/2016 Shimamoto ..... B41J 2/47
2013/0308983 A1 11/2013 Takano
2015/0050043 A1 * 2/2015 Sato ..... G03G 21/1633 399/110
2018/0364614 A1 12/2018 Aruga et al.

FOREIGN PATENT DOCUMENTS

JP 2015-175886 A 10/2015

* cited by examiner

*Primary Examiner* — Erika J Villaluna
(74) *Attorney, Agent, or Firm* — Foley & Lardner LLP

(57) ABSTRACT

An operating mechanism for an image forming apparatus includes a translating member, a rotating member, and a rib. The translating member defines a first engagement surface. The translating member moves along an axis that extends in a first direction. The rotating member is coupled to the translating member such that the translating member is both (a) movable relative to the rotating member along the axis and (b) rotatable relative to the rotating member about the axis. The rotating member defines a second engagement surface configured to engage the first engagement surface to regulate movement of the translating member such that a rotational displacement of the translating member about the axis has a corresponding linear displacement of the translating member along the axis. The rib is coupled to the rotating member and configured to reinforce the rotating member in order to resist deformation of the rotating member.

20 Claims, 18 Drawing Sheets

OPERATING MECHANISM AND IMAGE FORMING APPARATUS

FIELD

Embodiments described herein relate generally to an operating mechanism and an image forming device.

BACKGROUND

As an exposure light source of an image forming apparatus, for example, a line-type light source such as an LED array may be used. The line-type light source is held by the exposure head. The exposure head is supported by a lifting mechanism that moves up and down toward the photosensitive drum. The lifting mechanism raises and lowers the exposure head between a contact position in which the exposure head comes closest to the photosensitive drum unit and a separated position that forms a larger gap between the exposure head and the photosensitive drum unit than the contact position does. In particular, if the gap at the separated position is too small, there is a possibility that the photosensitive drum unit cannot be attached or detached, and that the cleaning of the exposure head becomes difficult.

DETAILED DESCRIPTION

In general, according to one embodiment, the operating mechanism includes a linear motion member, a rotating member, a rib, and an operation member. The linear motion member includes a first engagement portion. The linear motion member moves along an axis that is long in a first direction. The rotating member includes a second engagement portion. The second engagement portion has a length in the first direction and a circumferential direction around the axis. The second engagement portion engages with the first engagement portion in the first direction. The rotating member holds the linear motion member to be rotatable around the axis and movable in a direction along the axis in a state where the first engagement portion is engaged with the second engagement portion. The rotating member regulates the amount of movement of the linear motion member along the axis by the second engagement portion to a predetermined moving distance. The rib is provided on the rotating member. The rib reinforces the rotating member in order to reduce the deformation of the second engagement portion and prevent the error in the amount of movement with respect to the moving distance. The operation member rotates the linear motion member around the axis.

Figure 1:
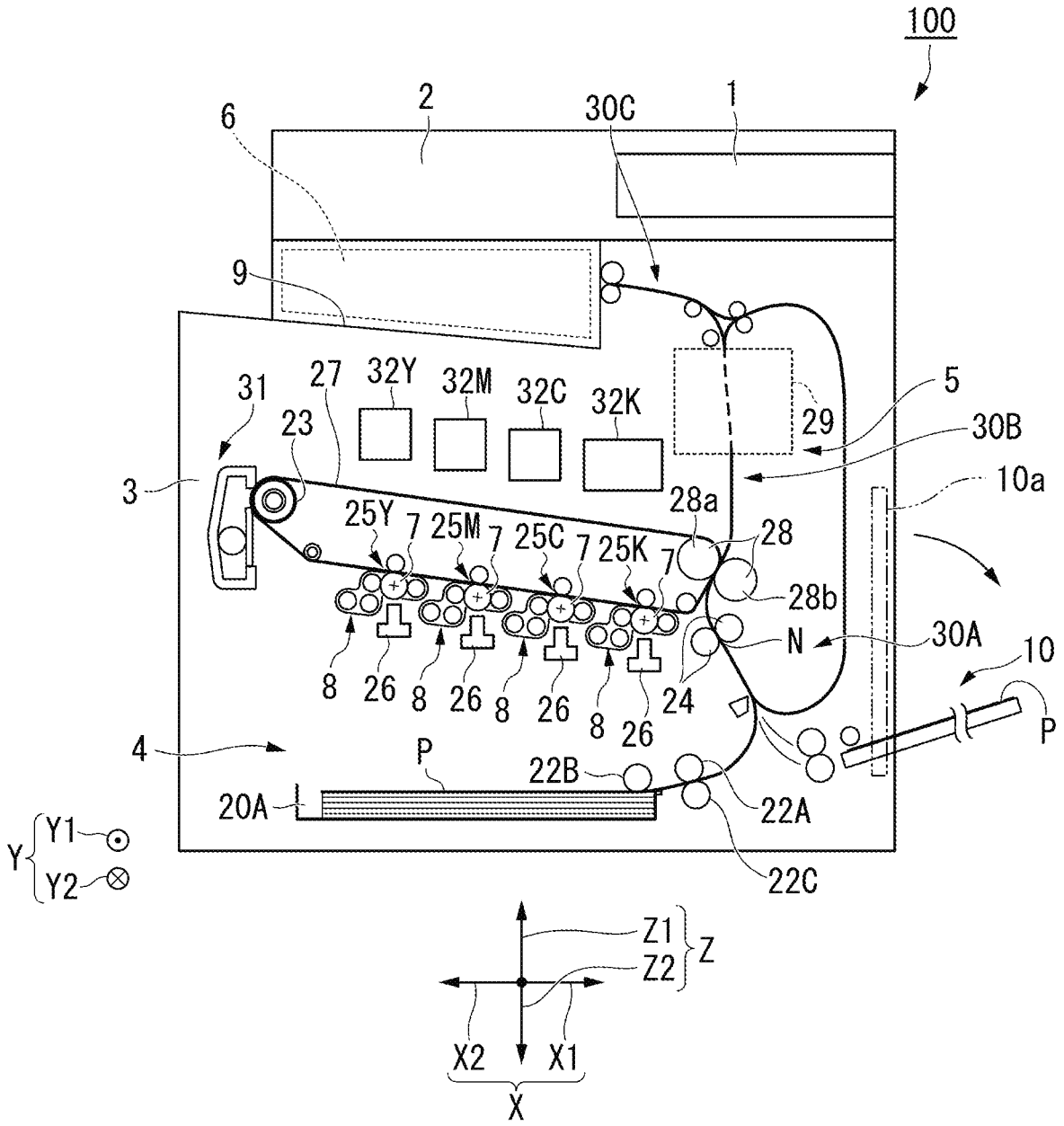
FIG. 1 is a schematic cross-sectional view illustrating an image forming apparatus according to an embodiment.

Hereinafter, an image forming apparatus according to an embodiment will be described with reference to the drawings. In the following drawings, the same or corresponding components are denoted by the same reference numerals unless otherwise specified. FIG. 1 is a schematic cross-sectional view illustrating an example of the entire configuration of the image forming apparatus according to the embodiment.

As illustrated in FIG. 1, an image forming apparatus 100 according to the present embodiment includes a control panel 1 (e.g., a user interface), a scanner unit 2 (e.g., a scanner), a printer unit 3 (e.g., a printer), a sheet feeding unit 4, a conveyance unit 5, a manual feeding unit 10, and a control unit 6 (e.g., a controller). Hereinafter, when referring to the relative position in the image forming apparatus 100, the X1, X2, Y1, Y2, Z1, and Z2 directions illustrated in the drawings may be used. The X1 direction is a direction from left to right when standing in front of the image forming apparatus 100 (e.g., the front side of FIG. 1). The X2 direction is a direction opposite to the X1 direction. The Y1 direction is a direction from the back to the front of the image forming apparatus 100. The Y2 direction is a direction opposite to the Y1 direction. The Z1 direction is a vertically upward direction. The Z2 direction is a vertically downward direction. When it is not necessary to differentiate between the X1 (Y1 and Z1) direction and the X2 (Y2 and Z2) direction, or when both facing directions are included, the direction is simply referred to as X (Y and Z) direction. A plane normal to the X direction is referred to as the YZ plane, a plane normal to the Y direction is referred to as the ZX plane, and a plane normal to the Z direction is referred to as the XY plane. The ZX plane is parallel to the conveyance direction of a sheet P in the image forming apparatus 100. The XY plane is a horizontal plane. Unless otherwise specified, the shape of each member of the image forming apparatus 100 will be described based on the arrangement posture in the image forming apparatus 100.

The control panel 1 operates the image forming apparatus 100 when a user performs an operation (e.g., provides an input, such as a touch input or a button press, to the control panel 1). The scanner unit 2 reads image information of a copy object (e.g., an image on a sheet) based on brightness and darkness of light. The scanner unit 2 outputs the read image information to the printer unit 3.

The printer unit 3 forms an image on the sheet P based on image information from the scanner unit 2 or from an outside source (e.g., a computer). The printer unit 3 forms an output image (e.g., a toner image) using a developer containing toner. The printer unit 3 transfers the toner image onto the surface of the sheet P. The printer unit 3 fixes the toner image to the sheet P by applying heat and pressure to the toner image on the surface of the sheet P.

The sheet feeding unit 4 supplies the sheets P one by one to the printer unit 3 at the timing when the printer unit 3 forms a toner image. The sheet feeding unit 4 includes a sheet feeding cassette 20 and a cassette sheet feeding unit 21. The sheet feeding cassette 20 stores sheets P of various sizes. The cassette sheet feeding unit 21 is located above an end of the sheet feeding cassette 20 in the X1 direction. The cassette sheet feeding unit 21 includes a pickup roller 22B, a sheet feeding roller 22A, and a separation roller 22C.

The pickup roller 22B conveys a sheet P required for image formation from the sheet feeding cassette 20 to a nip portion between the sheet feeding roller 22A and the separation roller 22C. The sheet feeding roller 22A conveys the sheet P conveyed to the nip portion to the conveyance unit 5. The separation roller 22C separates one sheet P when a plurality of sheets P are conveyed.

The conveyance unit 5 includes a pair of registration rollers 24. The registration rollers 24 align the leading end of the sheet P fed by the sheet feeding roller 22A at a nip N. The registration rollers 24 convey the sheet P at a time at which the printer unit 3 transfers the toner image onto the sheet P. The registration rollers 24 convey the sheet P toward a transfer unit 28.

The printer unit 3 includes image forming units 25Y, 25M, 25C, and 25K, an exposure unit 26, an intermediate transfer belt 27, the transfer unit 28, a fixing device 29, and a transfer belt cleaning unit 31.

The image forming units 25Y, 25M, 25C, and 25K are arranged in this order in the X1 direction. Each of the image forming units 25Y, 25M, 25C, and 25K forms a toner image to be transferred to the sheet P on the intermediate transfer belt 27. Each of the image forming units 25Y, 25M, 25C, and 25K includes a photosensitive drum 7. The image forming units 25Y, 25M, 25C, and 25K form yellow, magenta, cyan, and black toner images on the respective photosensitive drums 7. Around the photosensitive drums 7, a charger, the exposure unit 26, a developing device 8, a primary transfer roller, a cleaning unit, and a static eliminator are arranged. The primary transfer roller faces the photosensitive drum 7. The intermediate transfer belt 27 is interposed between the primary transfer roller and the photosensitive drum 7. The photoconductive drums 7 is just an example of a photoconductive body. The photoconductive body may be such drum shape or a belt shape.

Above the image forming units 25Y, 25M, 25C, and 25K, toner cartridges 32Y, 32M, 32C, and 32K are arranged. The toner cartridges 32Y, 32M, 32C, and 32K contain yellow, magenta, cyan, and black toners, respectively. Each toner of the toner cartridges 32Y, 32M, 32C, and 32K is supplied to the image forming units 25Y, 25M, 25C, and 25K by a toner supply pipe (not illustrated).

The exposure unit 26 irradiates the charged surface of each photosensitive drum 7 with light. Light emission is controlled based on image information. The exposure unit 26 of the present embodiment includes a light source in which a plurality of light emitting elements are arranged in the Y1 direction. In the example illustrated in FIG. 1, the exposure unit 26 is disposed below each of the image forming units 25Y, 25M, 25C, and 25K. Each exposure unit 26 is supplied with image information corresponding to yellow, magenta, cyan, and black, respectively. Each exposure unit 26 forms an electrostatic latent image on the surface of each photosensitive drum 7 based on image information.

The intermediate transfer belt 27 is an endless belt. Tension is applied to the intermediate transfer belt 27 by a plurality of rollers that are in contact with an inner peripheral surface of the intermediate transfer belt 27. The intermediate transfer belt 27 is stretched flat. The inner peripheral surface of the intermediate transfer belt 27 abuts on a support roller 28*a* at the most distant position in the X1 direction in the stretching direction. The inner peripheral surface of the intermediate transfer belt 27 abuts on a transfer belt roller 23 at the most distant position in the X2 direction in the stretching direction. The support roller 28*a* forms a part of the transfer unit 28. The support roller 28*a* guides the intermediate transfer belt 27 to a secondary transfer position. The transfer belt roller 23 guides the intermediate transfer belt 27 to a cleaning position.

The image forming units 25Y, 25M, 25C, and 25K (excluding the primary transfer rollers) are arranged in this order on the lower surface side in the drawing of the intermediate transfer belt 27 in the X1 direction. The image forming units 25Y, 25M, 25C, and 25K are arranged in a region between the transfer belt roller 23 and the support roller 28*a* with a space therebetween. When the toner image reaches a primary transfer position, a transfer bias is applied to the primary transfer rollers of the image forming units 25Y, 25M, 25C, and 25K. Each primary transfer roller primarily transfers the toner image from the surface of each photosensitive drum 7 onto the intermediate transfer belt 27.

In the intermediate transfer belt 27, the transfer unit 28 is disposed at a position adjacent to the image forming unit 25K. The transfer unit 28 includes the support roller 28*a* and a secondary transfer roller 28*b*. The secondary transfer roller 28*b* and the support roller 28*a* sandwich the intermediate transfer belt 27 therebetween. The position where the secondary transfer roller 28*b* and the intermediate transfer belt 27 contact each other is the secondary transfer position. The transfer unit 28 transfers the charged toner image from the intermediate transfer belt 27 onto the surface of the sheet P at the secondary transfer position. The transfer unit 28 applies a transfer bias (e.g., a charge) at the secondary transfer position. The transfer unit 28 transfers the toner image on the intermediate transfer belt 27 to the sheet P by the transfer bias.

The fixing device 29 applies heat and pressure to the sheet P. The fixing device 29 fixes the toner image transferred to the sheet P using the heat and the pressure. The fixing device 29 is disposed above the transfer unit 28. The transfer belt cleaning unit 31 faces the transfer belt roller 23. The transfer belt cleaning unit 31 sandwiches the intermediate transfer belt 27. The transfer belt cleaning unit 31 scrapes the toner on the surface of the intermediate transfer belt 27.

Between the registration rollers 24 and the transfer unit 28 and between the transfer unit 28 and the fixing device 29, conveyance paths 30A and 30B for conveying the sheet P upward from below are respectively formed in this order. Each of the conveyance paths 30A, 30B, and 30C includes a conveyance guide unit (e.g., a guide) and a conveyance roller that face each other with the sheet P interposed therebetween.

The manual feeding unit 10 supplies the sheet P on which an image is formed to the printer unit 3. When a manual feeding tray 13 is used, as illustrated by a solid line, the manual feeding tray 13 is opened by being rotated clockwise in the drawing. Sheets P of various sizes can be placed on the opened manual feeding tray 13. The manual feeding unit 10 includes a pickup roller, a sheet feeding roller, and a separation roller, similar to the sheet feeding unit 4.

The control unit 6 controls the entire image forming apparatus 100 and each unit of the apparatus. For example, the control unit 6 controls the control panel 1, the scanner unit 2, the printer unit 3, the sheet feeding unit 4, the conveyance unit 5, and the manual feeding unit 10 to convey the sheet P and form an image on the sheet P. As a device configuration of the control unit 6, for example, a processor such as a central processing unit (CPU) may be used.

Figure 2:
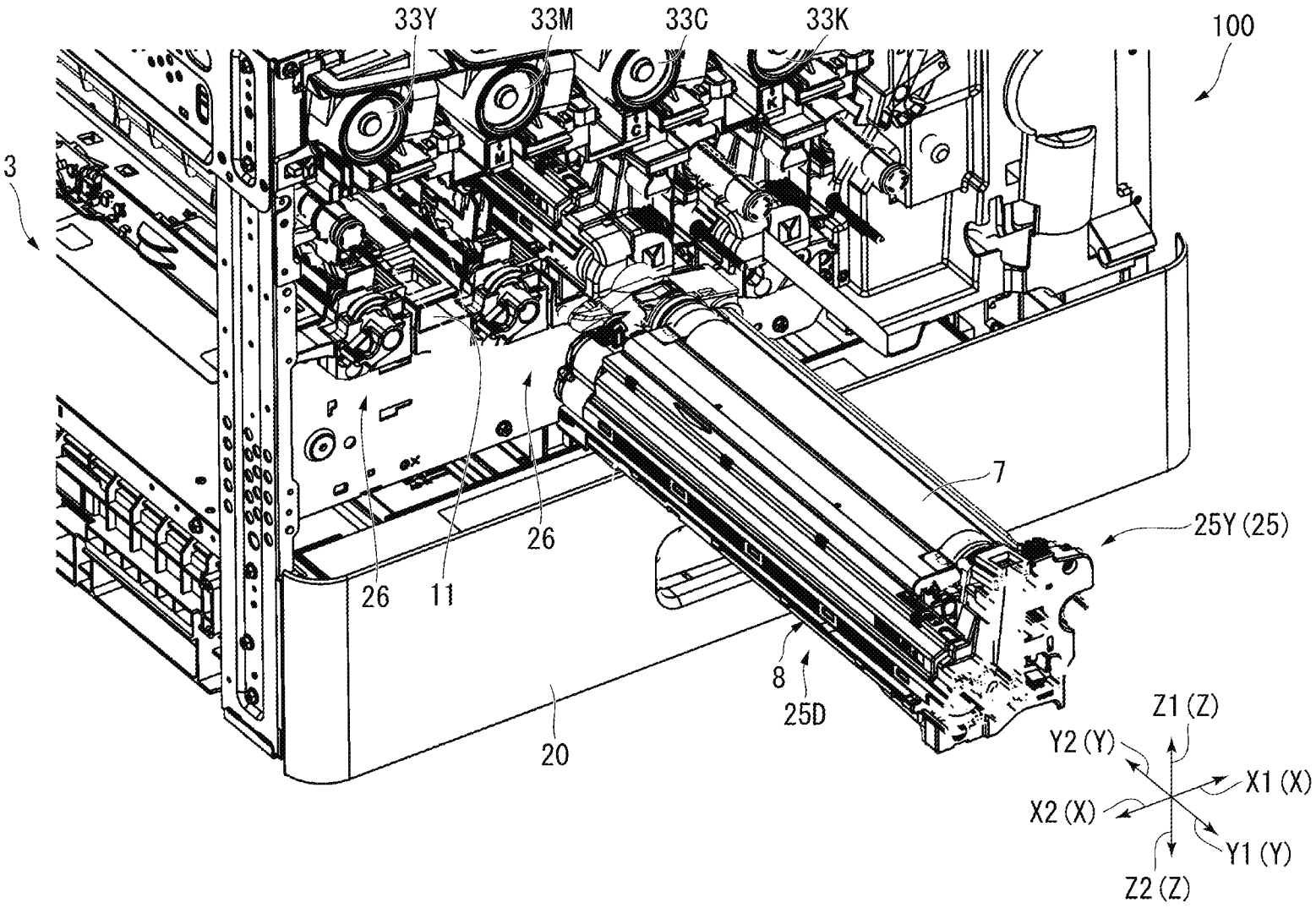
FIG. 2 is a schematic perspective view of the image forming apparatus of FIG. 1 illustrating a state where a photosensitive drum unit is pulled out from the image forming apparatus.
Figure 3:
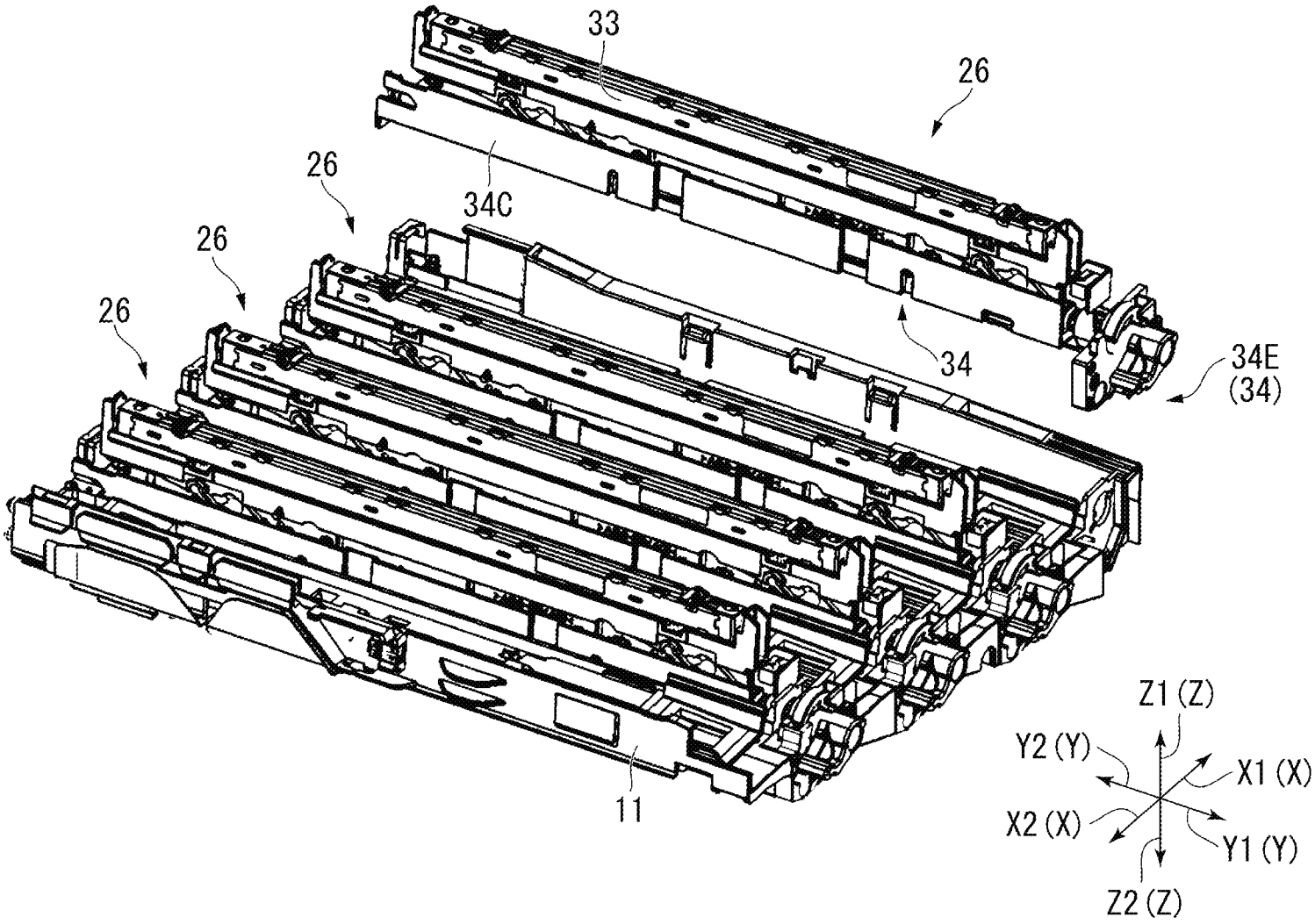
FIG. 3 is a schematic perspective view of an exposure unit and a base of the image forming apparatus of FIG. 1.
Figure 4:
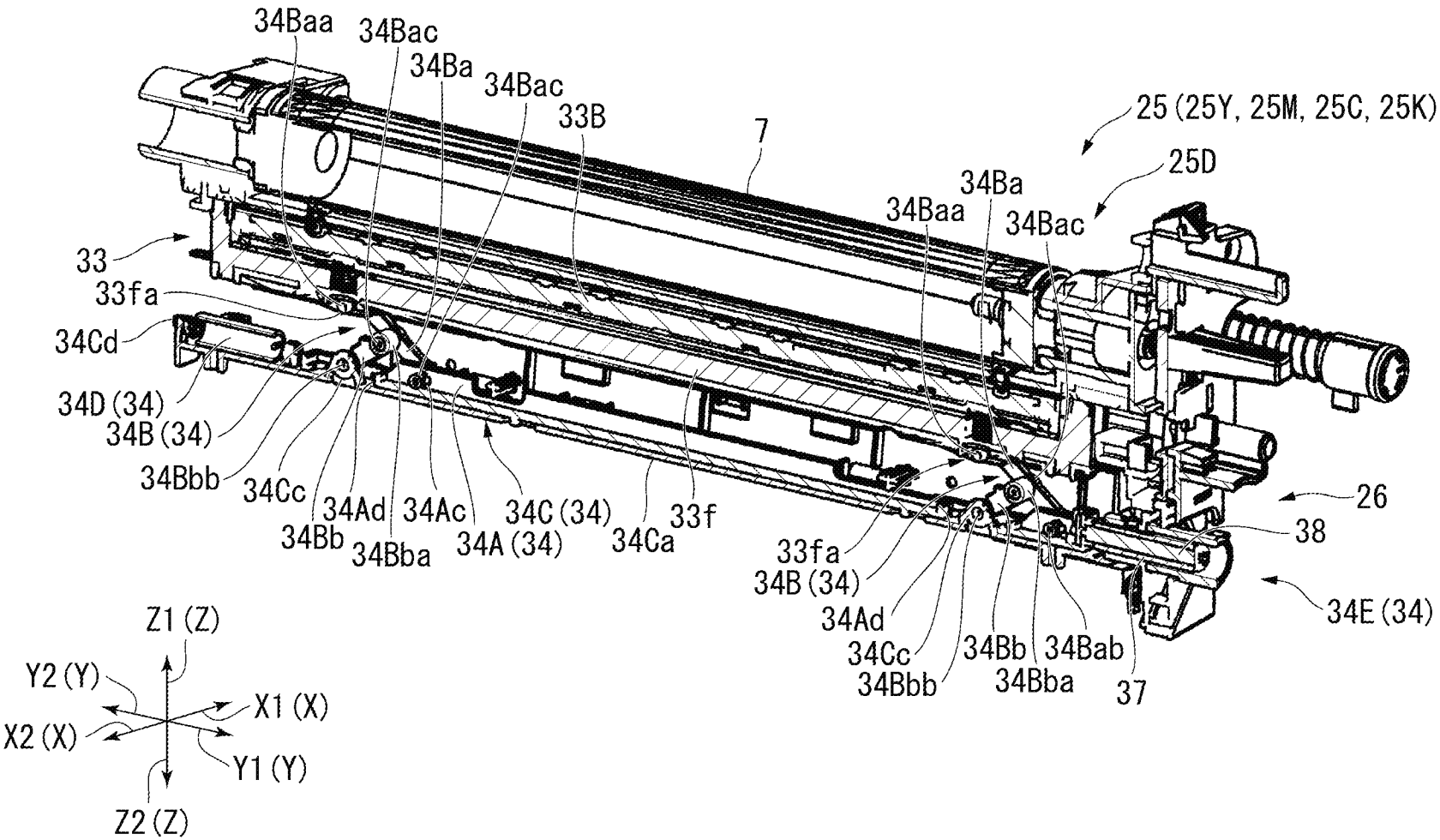
FIG. 4 is a schematic perspective view of the exposure unit of FIG. 3 and a lifting mechanism at a contact position.
Figure 5A:
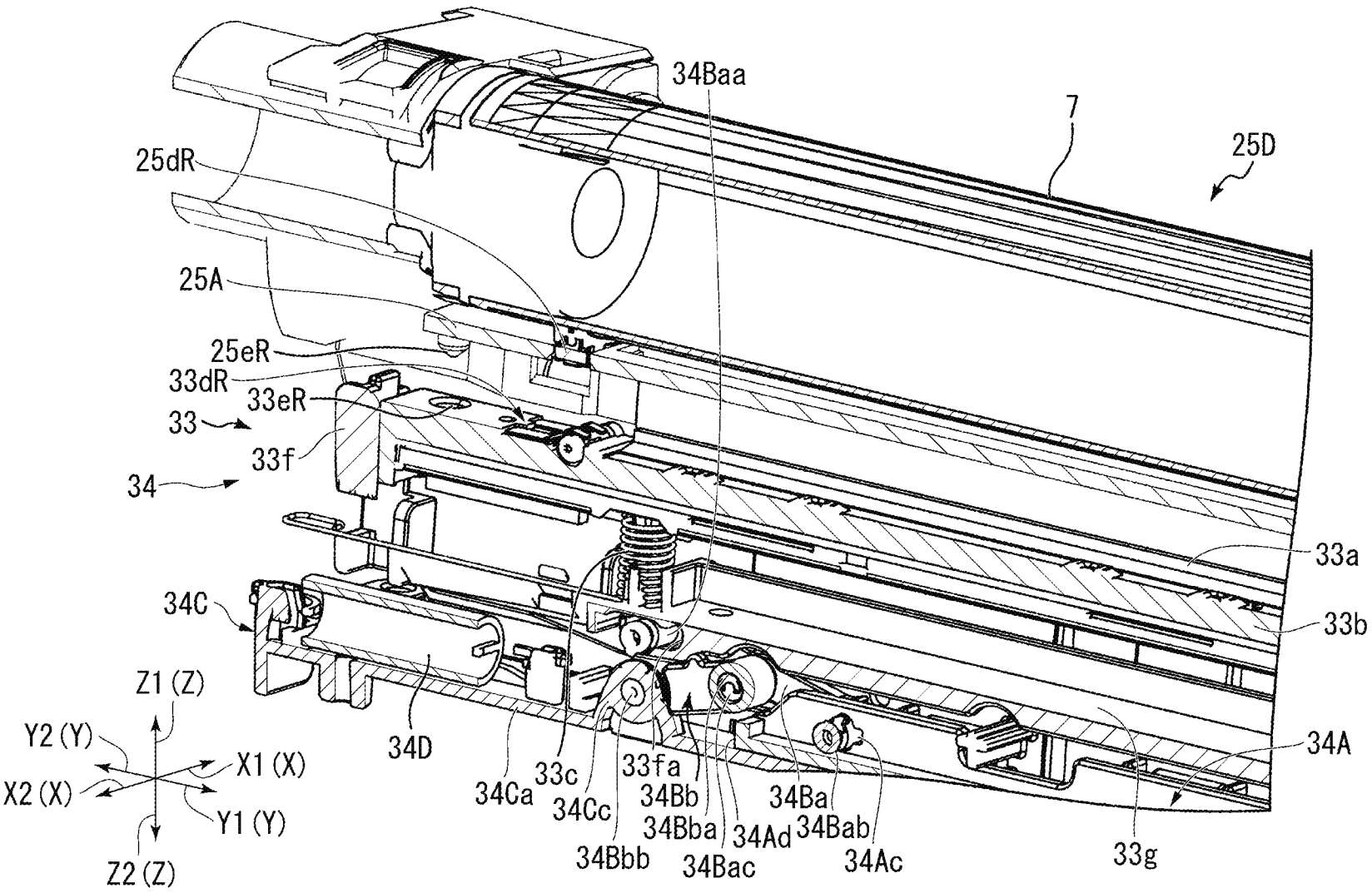
FIG. 5A is a schematic perspective view of the exposure unit and the lifting mechanism of FIG. 4 at a separated position on the rear side of the image forming apparatus.
Figure 5B:
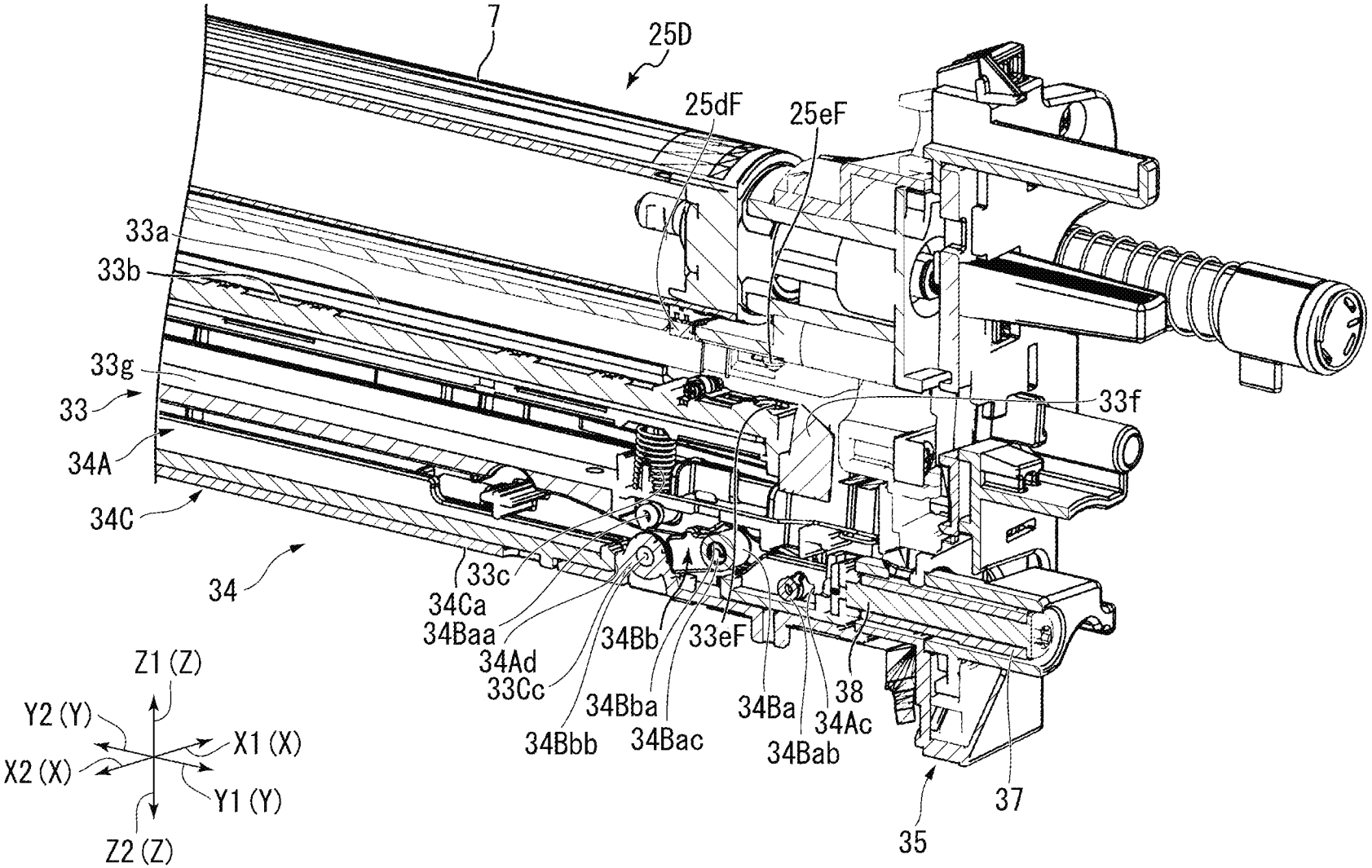
FIG. 5B is a schematic perspective view of the exposure unit and the lifting mechanism of FIG. 4 at the separated position on the front side of the image forming apparatus.
Figure 6:
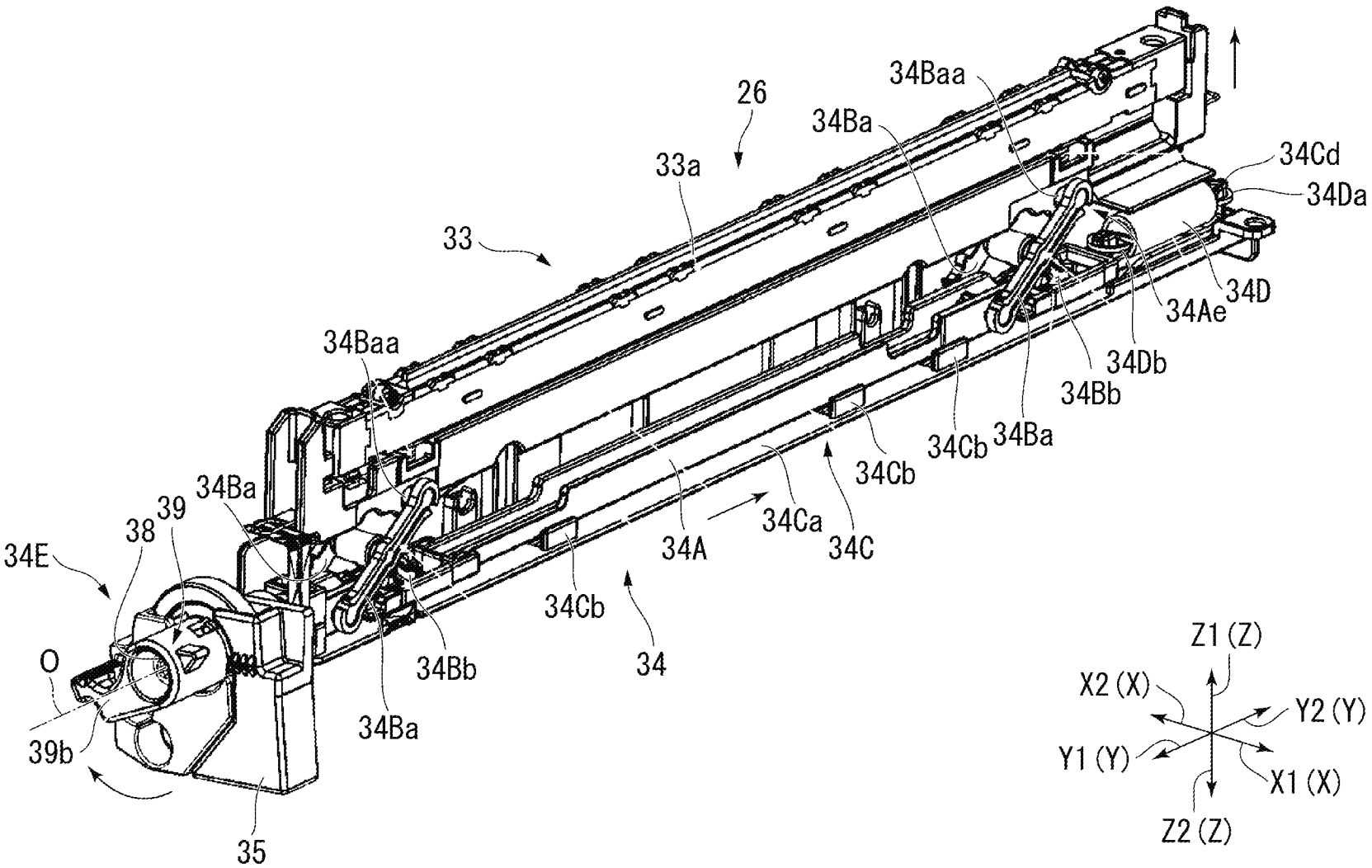
FIG. 6 is a schematic perspective view of the exposure unit and the lifting mechanism of FIG. 4 at the contact position.
Figure 7:
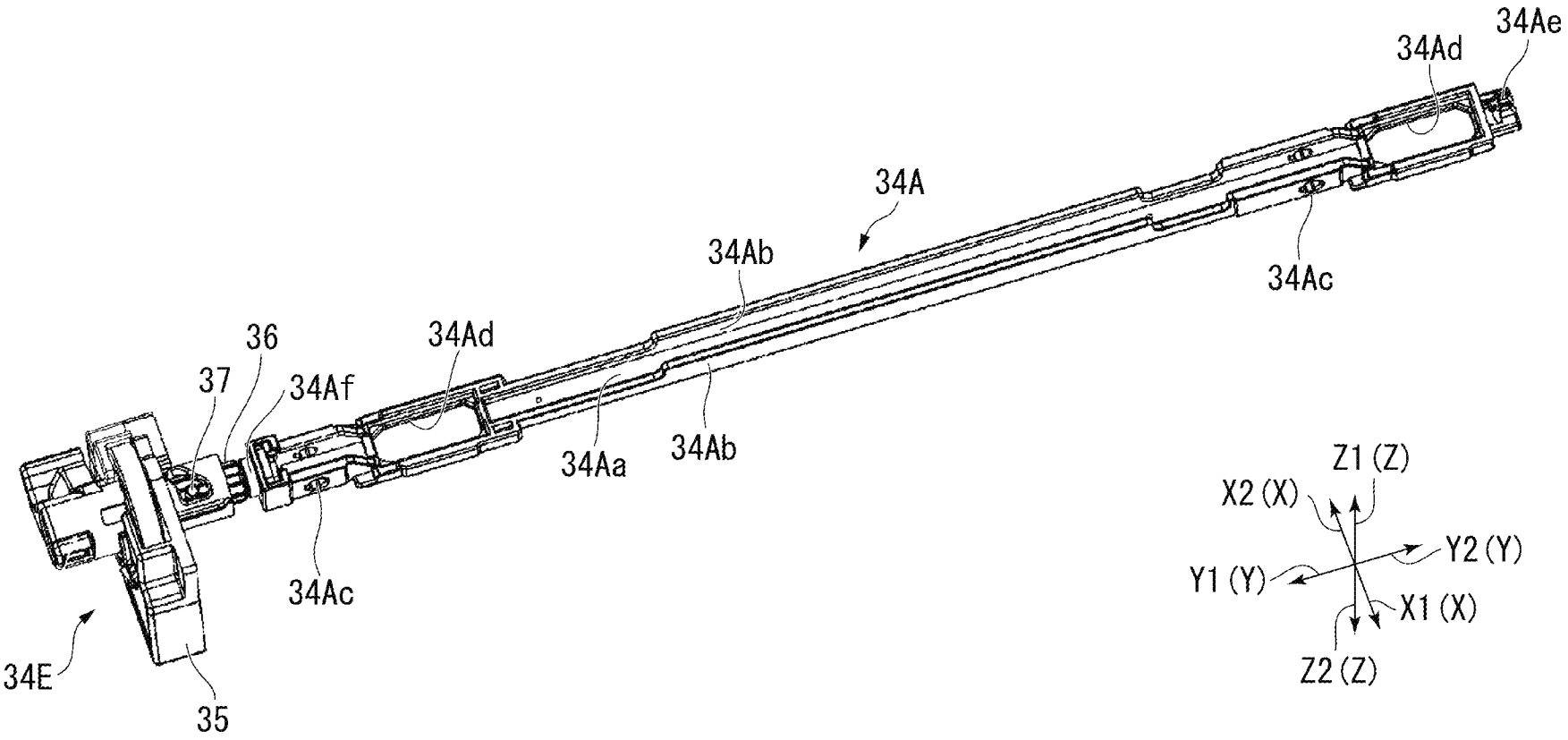
FIG. 7 is a schematic perspective view of a first link and an operating mechanism of the lifting mechanism of FIG. 4.

The detailed configuration of each exposure unit 26 will be described. The configuration of each exposure unit 26 is common to each other (e.g., each exposure unit 26 has a similar configuration). Hereinafter, the image forming units 25Y, 25M, 25C, and 25K disposed above the exposure units 26 are referred to generically as the image forming unit 25 when not distinguished from each other. FIG. 2 is a schematic side view illustrating the photosensitive drum, the exposure unit, and a mechanism in the image forming apparatus according to the first embodiment. FIG. 3 is an exploded view of the exposure unit and the mechanism in the image forming apparatus according to the first embodiment. FIG. 4 is a schematic diagram of a cross section taken along line F4-F4 in FIG. 3. FIG. 5 is a schematic perspective view illustrating the exposure unit and a stay in the image forming apparatus according to the first embodiment. FIG. 6 is a schematic diagram of a cross section taken along line F6-F6 in FIG. 5. FIG. 6 is a schematic perspective view of the exposure unit and a lifting mechanism at a contact position in the image forming apparatus of the embodiment. FIG. 7 is a schematic perspective view of a first link and an operating mechanism in the image forming apparatus according to the embodiment.

As illustrated in FIG. 2 by the image forming unit 25Y, each image forming unit 25 is unitized as a photosensitive drum unit 25D (e.g., a photosensitive drum assembly) excluding the exposure unit 26 and the primary transfer roller. The photosensitive drum unit 25D can be pulled out in the Y1 direction while the exposure unit 26 and the primary transfer roller remain inside the printer unit 3. Each exposure unit 26 is arranged on a base 11 or frame provided in the printer unit 3. As illustrated in FIG. 3, the exposure units 26 are separated from each other in the X direction on the base 11. The position of each exposure unit 26 in the X direction corresponds to the exposure position on each photosensitive drum 7 (e.g., the exposure unit 26 corresponding to the image forming unit 25Y is positioned farther in the X2 direction than the exposure unit corresponding to the image forming unit 25K). The height of the lower surface of each exposure unit 26 is determined by the base 11.

As illustrated in FIGS. 3 and 4, the exposure unit 26 includes an exposure head 33 (e.g., a light source) and a lifting mechanism 34 (e.g., a lifting actuator assembly). The exposure head 33 forms an electrostatic latent image on the photosensitive drum 7. As illustrated in FIGS. 5A and 5B, the exposure head 33 includes an exposure device 33*a* (e.g., a light source), a holder 33*b*, a support member 33*f*, and a biasing member 33*c* (e.g., a spring).

The exposure device 33*a* is elongated in one direction. The exposure device 33*a* includes a plurality of light emitting elements and a circuit board for causing the light emitting elements to emit light. For example, the plurality of light emitting elements are a solid-state light emitting element array. The plurality of light emitting elements are arranged in the longitudinal direction of the exposure device 33*a*. The longitudinal direction of the exposure device 33*a* is the Y direction in the image forming apparatus 100. For example, the plurality of light emitting elements may be an LED array, an organic EL array, or the like. The plurality of light emitting elements in the exposure device 33*a* emit light according to the drive current supplied from the circuit board. The exposure device 33*a* includes a lens that collects light from the plurality of light emitting elements. The lens focuses light from the plurality of light emitting elements in a spot shape at each focal position. The lens is not particularly limited as long as light from the plurality of light emitting elements can be independently focused. For example, a SELFOC lens array or the like may be used as the lens.

The holder 33*b* (e.g., a base, a frame, a frame member, etc.) holds (e.g., is coupled to) the exposure device 33*a*. The holder 33*b* is longer than the exposure device 33*a* in the Y1 direction and the Y2 direction. The holder 33*b* is supported by (e.g., movably or slidably coupled to) the support member 33*f* to be able to advance and retreat (e.g., translate) in a direction toward the photosensitive drum 7. The advancing and retreating direction of the holder 33*b* is a direction along the optical axis of the light emitted from the exposure device 33*a*. The incident angle of the optical axis with respect to the surface of the photosensitive drum 7 is not particularly limited. For example, the optical axis may be inclined with respect to the normal at the position of incidence on the photosensitive drum 7. The optical axis may be inclined with respect to the vertical plane. In the present embodiment, the optical axis of the exposure device 33*a* extends in the Z direction along the vertical plane, and the advancing and retreating direction of the holder 33*b* is the Z direction (e.g., the holder 33*b* and the exposure device 33*a* are configured to translate vertically relative to the support member 33*f*).

As illustrated in FIG. 5A, a contact surface 33*d*R (e.g., a stop surface) and a positioning portion 33*e*R (e.g., an aperture, a recess) are provided on the upper surface of the end of the holder 33*b* in the Y2 direction. The contact surface 33*d*R contacts a spacer 25*d*R (e.g., a protrusion, a stop) provided on a case 25A of the photosensitive drum unit 25D. The spacer 25*d*R protrudes downward from the lower surface of the case 25A. The spacer 25*d*R makes a fixed gap between the case 25A near the spacer 25*d*R and the holder 33*b* by making contact with the contact surface 33*d*R. The fixed gap has such a size that the focal position (e.g., the position of the focal point) of the lens of the exposure head 33 matches the surface of the photosensitive drum 7. In the present embodiment, the contact surface 33*d*R is provided on the upper surface of the holder 33*b* between the positioning portion 33*e*R and the end in the Y2 direction of the exposure head 33.

The positioning portion 33*e*R is fitted to (e.g., positioned and sized to engage) a pin 25*e*R (e.g., a protrusion) provided in the case 25A, and positions the exposure head 33 in the Y direction and the X direction with respect to the photosensitive drum 7 in the case 25A. For example, the positioning portion 33*e*R is a circular hole into which the column portion of the pin 25*e*R can be inserted and fitted.

As illustrated in FIG. 5B, a contact surface 33*d*F (e.g., a stop surface) and a positioning portion 33*e*F (e.g., an aperture, a recess) are provided on the upper surface of the end of the holder 33*b* in the Y1 direction. The contact surface 33*d*F contacts a spacer 25*d*F (e.g., a protrusion, a stop)

provided on the case 25A. The spacer 25*d*F protrudes downward from the lower surface of the case 25A. The spacer 25*d*F makes a fixed gap between the case 25A near the spacer 25*d*F and the holder 33*b* by making contact with the contact surface 33*d*F. The fixed gap has such a size that the focal position (e.g., the position of the focal point) of the lens of the exposure head 33 matches the surface of the photosensitive drum 7. In the present embodiment, the contact surface 33*d*F is provided on the upper surface of the holder 33*b* between the positioning portion 33*e*F and the end in the Y1 direction of the exposure head 33. The exposure head 33 is positioned in the Z direction by contacting the spacers 25*d*R and 25*d*F with the contact surfaces 33*d*R and 33*d*F such that the focal position of the lens thereof matches the surface of the photosensitive drum 7.

The positioning portion 33*e*F is fitted to (e.g., positioned and sized to engage) a pin 25*e*F (e.g., a protrusion) provided on the case 25A, and positions the exposure head 33 in the X direction. For example, the positioning portion 33*e*F is an elongated (e.g., oblong) hole that is elongated in the Y direction. For example, the positioning portion 33*e*F has a short width into which the column portion of the pin 25*e*F can be inserted and fitted in the X direction, and a longitudinal width longer than the diameter of the column portion of the pin 25*e*F.

The support member 33*f* supports the holder 33*b* while permitting the holder 33*b* to advance and retreat in the Z direction. A plurality of biasing members 33*c* (e.g., springs) are arranged on a bottom surface portion 33*g* of the support member 33*f*. Each biasing member 33*c* biases the end surface in the Z2 direction of the holder 33*b* toward the Z1 direction separated from the bottom surface portion 33*g*. The biasing force of each biasing member 33*c* is large enough to press the contact surfaces 33*d*R and 33*d*F against the spacers 25*d*R and 25*d*F with a constant load. The number of biasing members 33*c* is not particularly limited. In the present embodiment, the biasing members 33*c* are arranged at two locations at both ends in the Y direction of the bottom surface portion 33*g*. The pressing position of each biasing member 33*c* in the holder 33*b* is slightly inside the contact surfaces 33*d*R and 33*d*F in the Y direction. In the present embodiment, the pressing position of each biasing member 33*c* is substantially on the back side of both ends of the exposure device 33*a*. The biasing member 33*c* is not particularly limited as long as the biasing member 33*c* can bias the holder 33*b*. For example, the biasing member 33*c* may be a compression coil spring that expands and contracts in the Z direction. An engagement hole 33*fa* that is connected to the lifting mechanism 34 is provided below the bottom surface portion 33*g* that supports each biasing member 33*c*.

Figure 12:
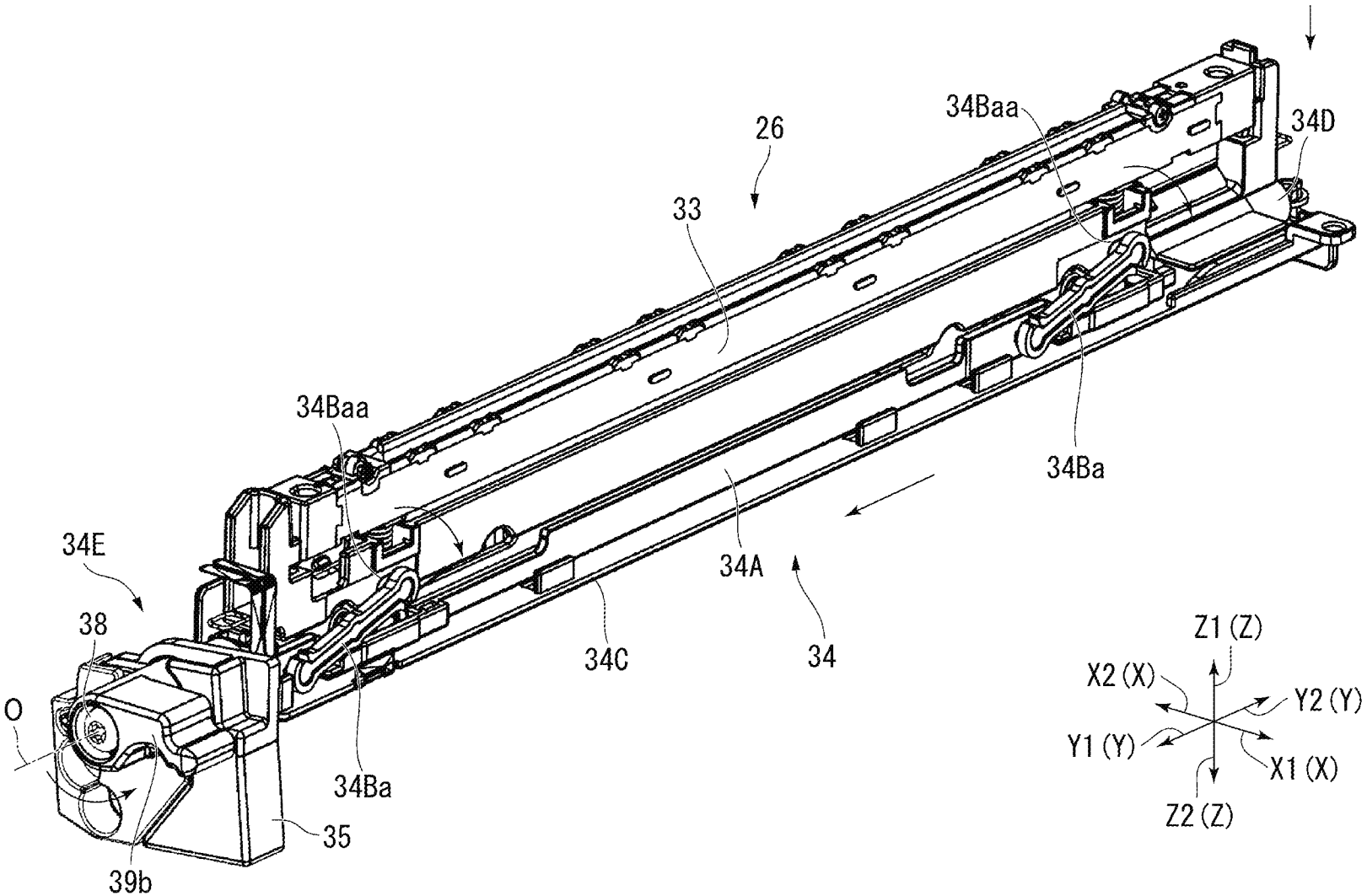
FIG. 12 is a schematic perspective view of the exposure unit and the lifting mechanism of FIG. 4 at the separated position.

The lifting mechanism 34 actuates the exposure head 33 to advance and retreat toward the photosensitive drum 7. In the present embodiment, the lifting mechanism 34 actuates the exposure head 33 to be movable in the Z direction. For example, FIGS. 4 and 6 illustrate a state where the lifting mechanism 34 raises the exposure head 33 to the contact position, which is the uppermost position. At the contact position, the contact surfaces 33*d*F and 33*d*R contact the spacers 25*d*F and 25*d*R, respectively. For example, FIGS. 5A, 5B, and 12 illustrate a state where the lifting mechanism 34 lowers the exposure head 33 to the separated position, which is the lowest position. At the separated position, the contact surfaces 33*d*F and 33*d*R are separated from the spacers 25*d*F and 25*d*R, respectively, and a gap wider than the gap at the contact position is formed between the case 25A and the exposure head 33 in the Z direction.

As illustrated in FIG. 4, the lifting mechanism 34 includes a support member 34C, a first link 34A (e.g., a sliding link), a link mechanism 34B (e.g., a linkage assembly), a biasing member 34D, and an operating mechanism 34E.

The support member 34C (e.g., a frame) is disposed below the exposure head 33. The support member 34C is provided below the exposure unit 26. The support member 34C includes a bottom surface portion 34Ca, a guide plate 34Cb (see FIG. 6), a support portion 34Cc, and a locking portion 34Cd.

The bottom surface portion 34Ca has a planar shape parallel to the XY plane. The bottom surface portion 34Ca is elongated in the Y direction. The support member 34C accommodates each member of the lifting mechanism 34 except for the support member 34C on the bottom surface portion 34Ca. As illustrated in FIG. 6, a plurality of guide plates 34Cb are provided on the bottom surface portion 34Ca and separated from one another in the Y direction. Each guide plate 34Cb includes two flat plates separated from and facing each other in the X direction and parallel to the YZ plane. The guide plate 34Cb guides the movement of the first link 34A in the Y direction (e.g., limits movement in the X direction).

As illustrated in FIG. 4, a plurality of support portions 34Cc are provided in accordance with the number of link mechanisms 34B. In the present embodiment, the support portions 34Cc are provided at two locations in the longitudinal direction of the bottom surface portion 34Ca, respectively, corresponding to two link mechanisms 34B. The support portion 34Cc rotatably supports a third link 34Bb of the link mechanism 34B in a plane parallel to the YZ plane. As illustrated in FIGS. 5A and 5B, each support portion 34Cc protrudes from the bottom surface portion 34Ca in the Z1 direction. The configuration of the support portion 34Cc is not particularly limited as long as the third link 34Bb can be rotatably supported. In the present embodiment, the support portion 34Cc is a bearing that rotatably supports an engagement shaft 34Bbb of the third link 34Bb.

As illustrated in FIG. 6, the locking portion 34Cd protrudes in the Z1 direction at the end of the bottom surface portion 34Ca in the Y2 direction. The locking portion 34Cd locks the end of the biasing member 34D (e.g., a spring) in the Y2 direction.

The first link 34A is disposed on the bottom surface portion 34Ca in the longitudinal direction of the bottom surface portion 34Ca. The first link 34A is elongated in the Y direction. The first link 34A is movably (e.g., slidably) supported on the bottom surface portion 34Ca in the Y direction. When moving the exposure head 33 to the contact position, the first link 34A moves most in the Y2 direction with respect to the support member 34C. When moving the exposure head 33 to the separated position, the first link 34A moves most in the Y1 direction with respect to the support member 34C.

As illustrated in FIG. 7, the first link 34A includes a bottom plate 34Aa. The bottom plate 34Aa is parallel to the XY plane and is long in the Y direction. Side plates 34Ab (e.g., flanges, protrusions) protrude in the Z1 direction from both ends of the bottom plate 34Aa in the X direction. Each side plate 34Ab is inserted between each guide plate 34Cb (see FIG. 6), and is movable in the Y direction along each guide plate 34Cb (e.g., the guide plates 34Cb slidably couple the first link 34A to the support member 34C). At both ends in the Y direction of each side plate 34Ab, a through-hole 34Ac (e.g., apertures) penetrating each side plate 34Ab in the X direction is formed. Openings 34Ad (e.g., apertures) that penetrate the bottom plate 34Aa in the Z direction are formed near the respective through-holes 34Ac in the bottom plate 34Aa. Each opening 34Ad is formed on the Y2 direction side of each through-hole 34Ac. As illustrated in FIG. 4, the support portion 34Cc, and the third link 34Bb supported by the support portion 34Cc are arranged inside each of the openings 34Ad. Each opening 34Ad is formed in a size that the support portion 34Cc and the third link 34Bb do not contact within the range of movement of the first link 34A in the Y direction.

As illustrated in FIG. 7, a locking portion 34Ae for locking the biasing member 34D (e.g., coupling the biasing member 34D to the first link 34A) is provided at the end of the first link 34A in the Y2 direction. At the end of the first link 34A in the Y1 direction, a fixing portion 34Af (e.g., a threaded portion) for fixing a stepped screw 38 (see FIG. 8) is provided.

As illustrated in FIG. 4, the link mechanism 34B is provided between the support member 34C and the holder 33*b* at two locations separated from each other in the Y direction. Each link mechanism 34B supports the holder 33*b* at two locations, that is, an end in the Y1 direction and an end in the Y2 direction of the holder 33*b*. Each link mechanism 34B connects the support member 34C and the holder 33*b*, and is also connected to the first link 34A. Each link mechanism 34B converts the movement of the first link 34A in the Y1 direction into the movement in the Z1 direction, thereby moving the holder 33*b* to be separated from the support member 34C in the Z1 direction. Similarly, each link mechanism 34B converts the movement of the first link 34A in the Y2 direction into the movement in the Z2 direction, thereby moving the holder 33*b* in the Z2 direction to approach the support member 34C.

The configuration of each link mechanism 34B is not particularly limited as long as the exposure head 33 can be moved in the Z direction in accordance with the movement of the first link 34A. The configuration of each link mechanism 34B is the same. In the present embodiment, each link mechanism 34B includes a second link 34Ba and the third link 34Bb.

Two second links 34Ba are provided to sandwich the third link 34Bb in the X direction. The shape of each second link 34Ba is plane-symmetric with respect to the YZ plane. Hereinafter, the shape of the second link 34Ba disposed on the X1 direction side of the third link 34Bb will be described. As for the shape of the second link 34Ba disposed on the X2 direction side of the third link 34Bb, in the following description, the X1 direction and the X2 direction may be interchanged.

The second link 34Ba is longer than the third link 34Bb. The second link 34Ba connects the first link 34A and the support member 33*f*. The second link 34Ba includes a first engagement shaft 34Baa, a second engagement shaft 34Bab, and a third engagement shaft 34Bac. The first engagement shaft 34Baa is an engagement portion connected to the holder 33*b*, and protrudes in the X2 direction at the end in the longitudinal direction of the second link 34Ba. The second engagement shaft 34Bab is an engagement portion connected to the first link 34A, and protrudes in the same direction as the first engagement shaft 34Baa at an end opposite to the end where the first engagement shaft 34Baa is formed in the longitudinal direction. The third engagement shaft 34Bac is an engagement portion connected to the third link 34Bb, and projects in the same direction as the first engagement shaft 34Baa between the first engagement shaft 34Baa and the second engagement shaft 34Bab.

The first engagement shaft 34Baa is rotatably engaged with the engagement hole 33*fa* of the support member 33*f* The second link 34Ba is connected to the support member 33*f* by the first engagement shaft 34Baa. The second engagement shaft 34Bab is rotatably engaged with the through-hole 34Ac of the first link 34A. The second link 34Ba is connected to the first link 34A by the second engagement shaft 34Bab. The third engagement shaft 34Bac is rotatably engaged with an engagement hole 34Bba provided at the end in the longitudinal direction of the third link 34Bb. The second link 34Ba is connected to the third link 34Bb by the third engagement shaft 34Bac.

The third link 34Bb connects the second link 34Ba and the support member 34C. The engagement hole 34Bba and the engagement shaft 34Bbb are formed at both ends in the longitudinal direction of the third link 34Bb.

The third engagement shafts 34Bac of the second links 34Ba are respectively inserted into the engagement holes 34Bba. The engagement holes 34Bba hold the third engagement shafts 34Bac coaxially. The third link 34Bb connects each second link 34Ba to be rotatable around the center of the engagement hole 34Bba. The engagement shaft 34Bbb is rotatably engaged with the support portion 34Cc. The third link 34Bb is connected to the support portion 34Cc by an engagement shaft 34Bbb.

The biasing member 34D biases the first link 34A in the Y2 direction within the movement range of the first link 34A. The configuration of the biasing member 34D is not particularly limited as long as the first link 34A can be biased in the Y2 direction. For example, as illustrated in FIG. 6, the biasing member 34D may be a tension coil spring that expands and contracts in the Y direction. In this case, the biasing member 34D includes a first hook 34Da at an end in the Y2 direction and a second hook 34Db at an end in the Y1 direction. The first hook 34Da is locked to the locking portion 34Cd, and the second hook 34Db is locked to the locking portion 34Ae. The biasing member 34D is extended from its natural length at the contact position of the exposure head 33 (e.g., to apply a minimum or base biasing force). The biasing member 34D is further extended at the separated position of the exposure head 33 than at the contact position (e.g., to apply a biasing force greater than the base biasing force).

Figure 8:
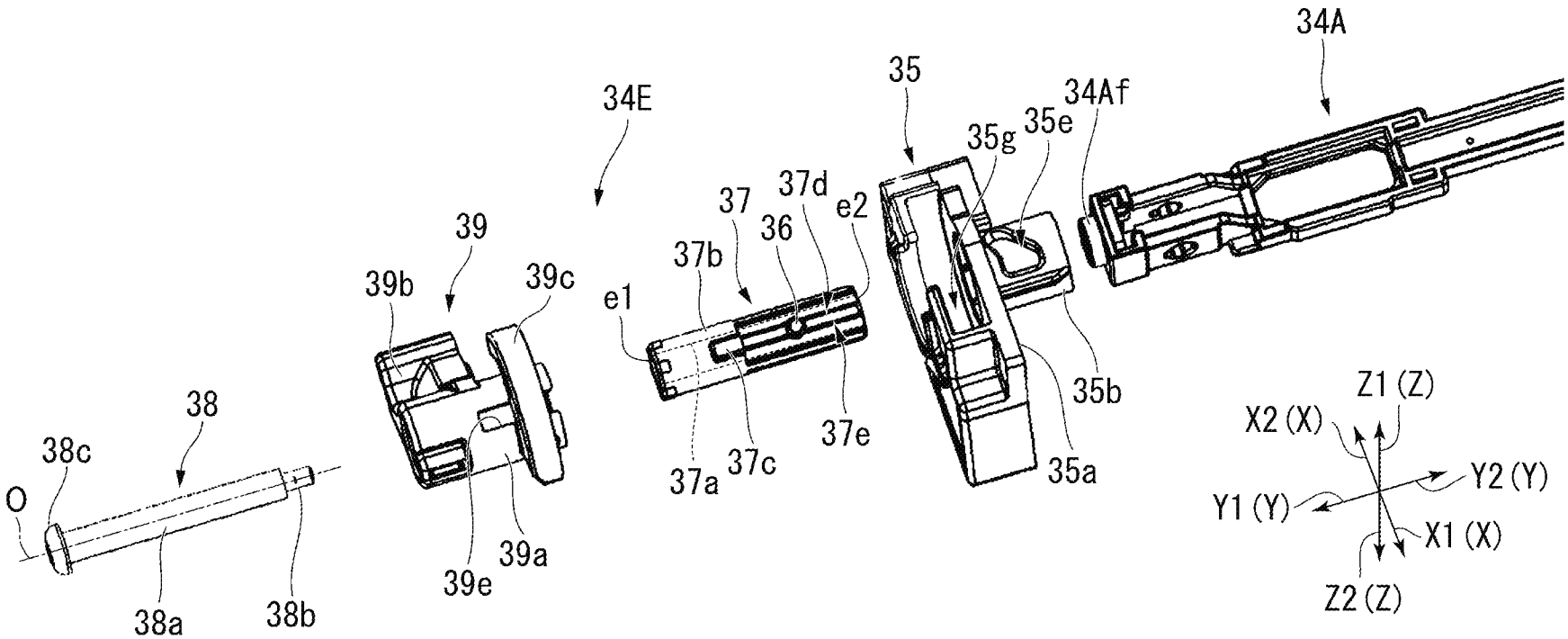
FIG. 8 is an exploded perspective view of the operating mechanism of FIG. 7.
Figure 9:
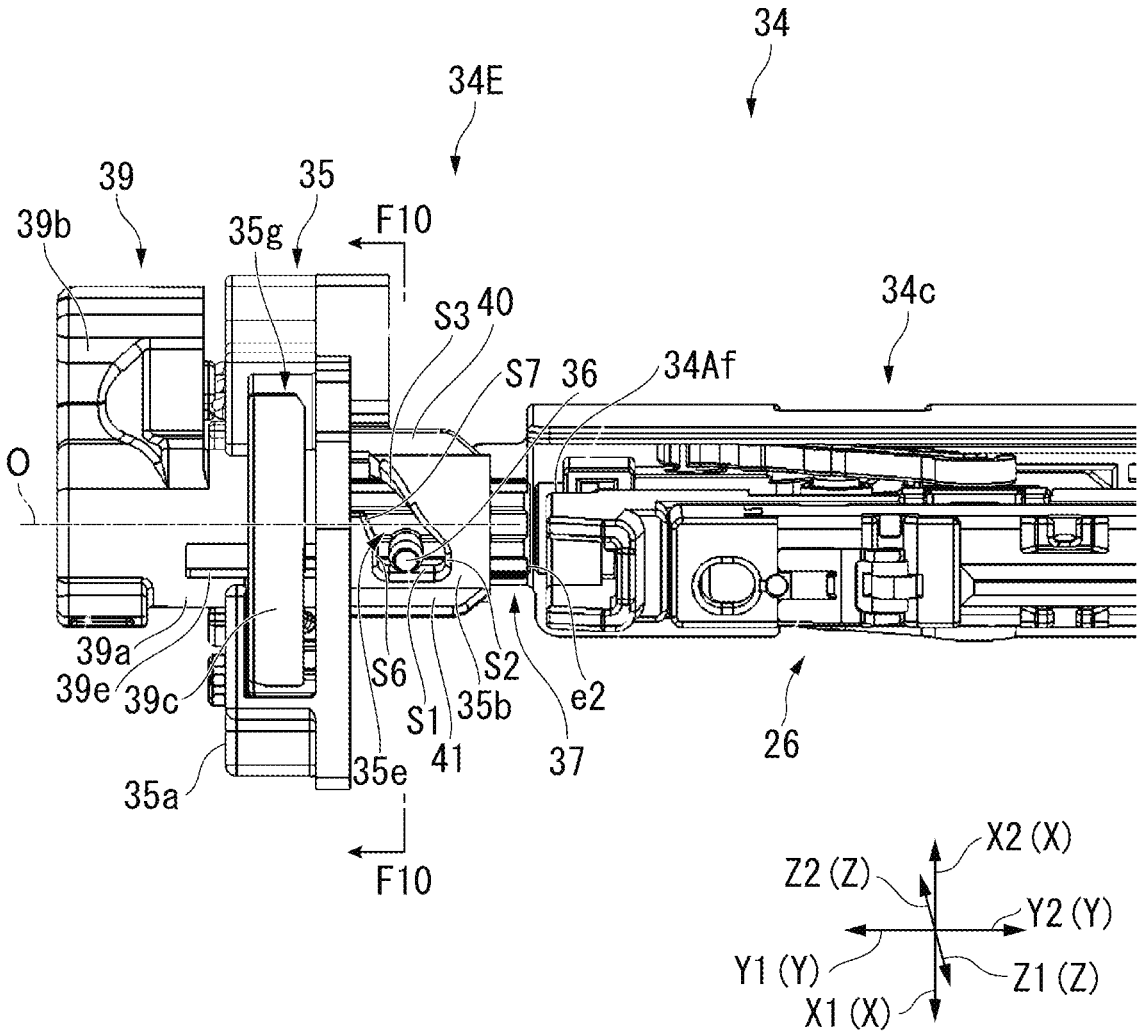
FIG. 9 is a schematic perspective view illustrating the operating mechanism of FIG. 7 at the contact position.
Figure 10:
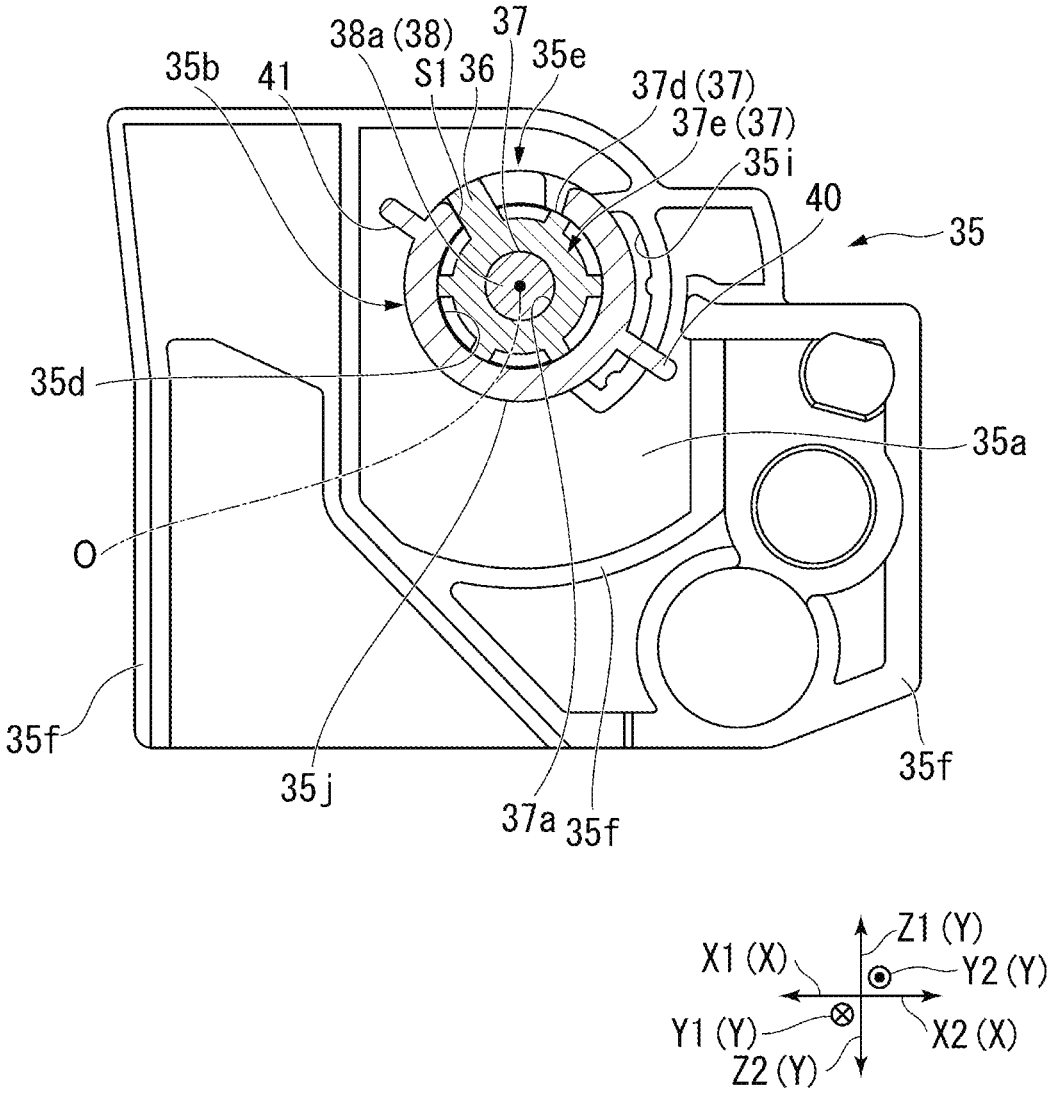
FIG. 10 is a schematic view of a cross section along line F10-F10 in FIG. 9.
Figure 11A:
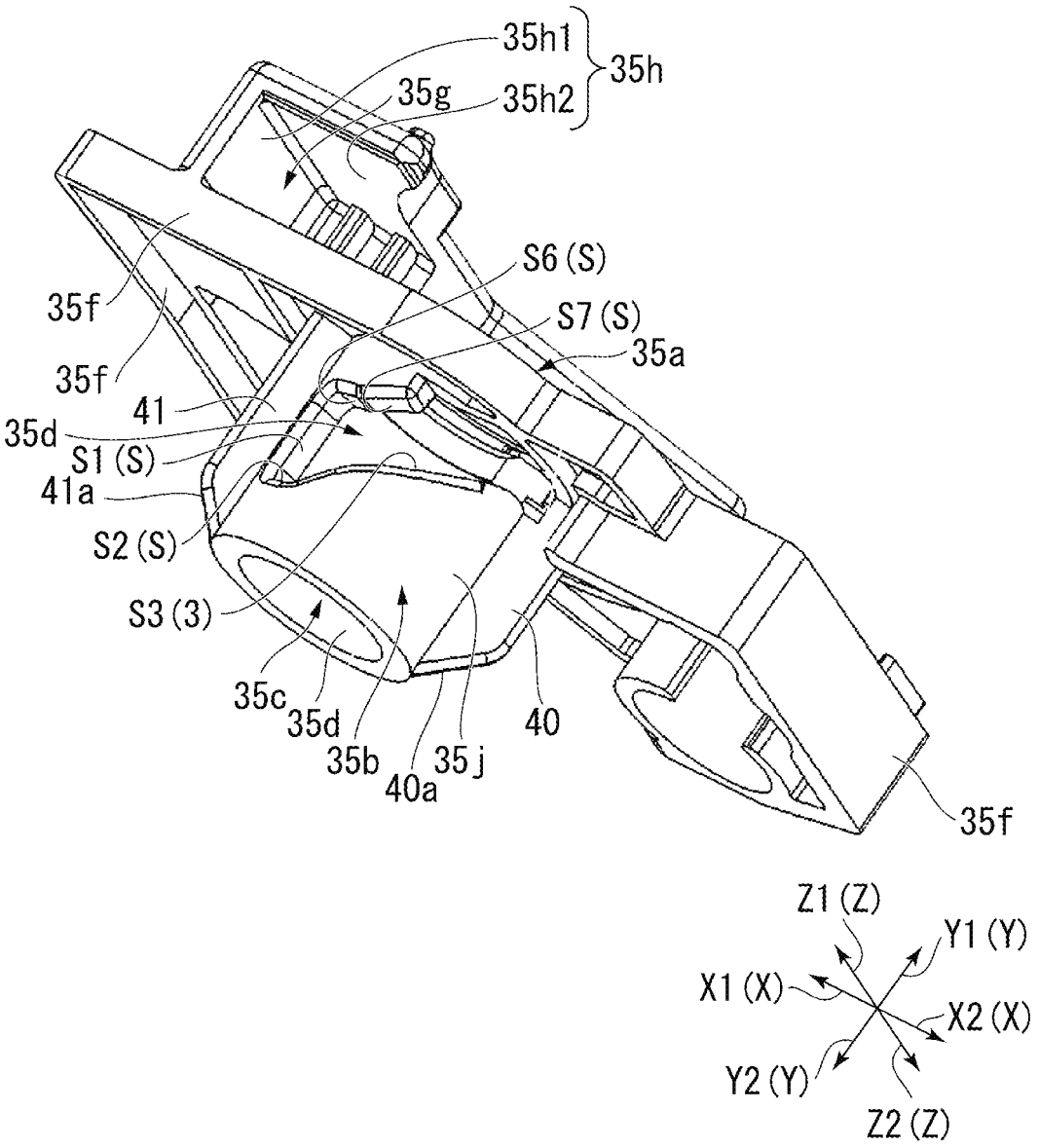
FIG. 11A is a schematic perspective view illustrating a rotating member of the operating mechanism of FIG. 7.
Figure 11B:
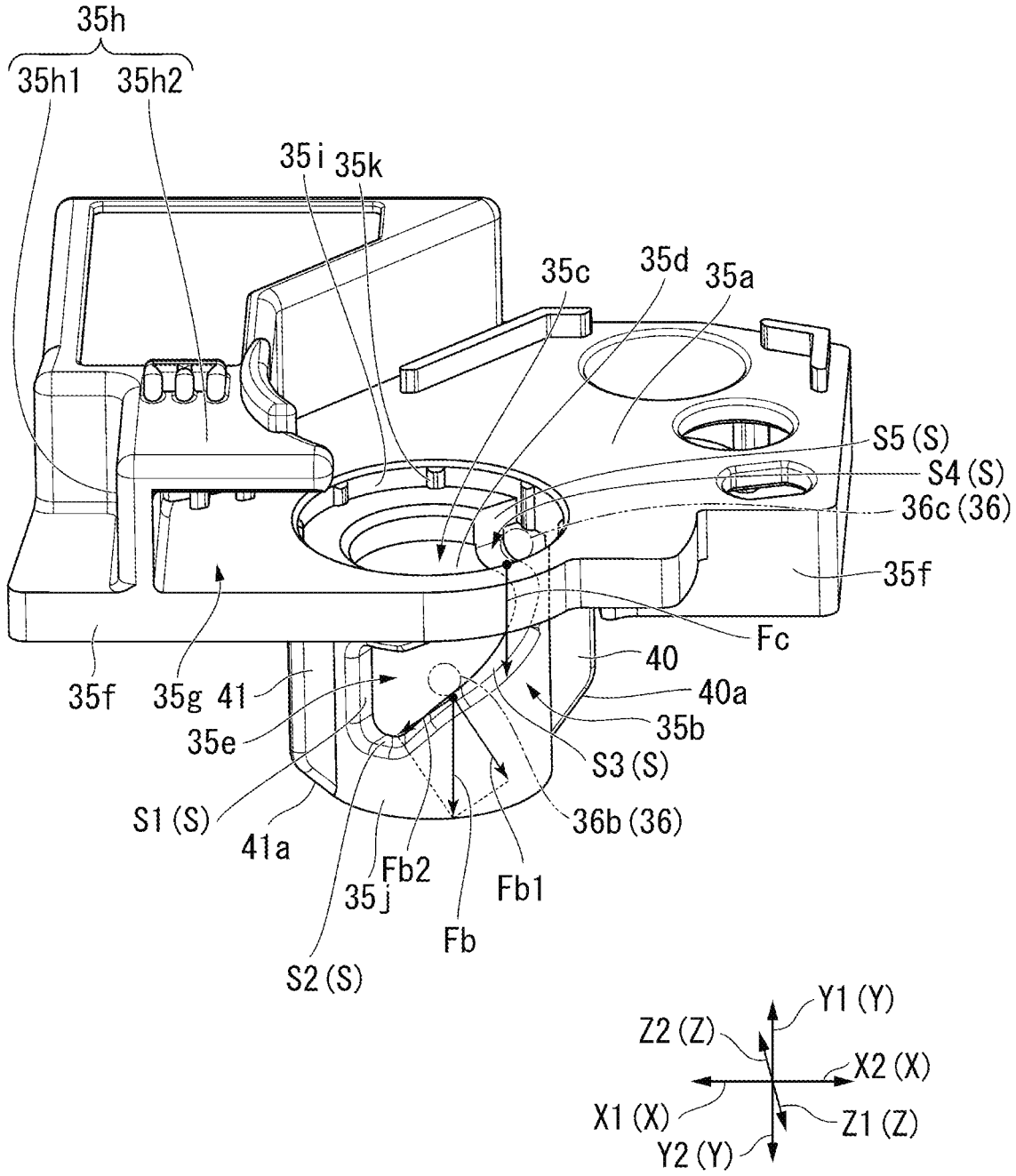
FIG. 11B is a schematic perspective view illustrating the rotating member of FIG. 11A.

The operating mechanism 34E will be described. FIG. 8 is an exploded perspective view of the operating mechanism 34E in the image forming apparatus according to the embodiment. FIG. 9 is a top view of the lift mechanism 34. FIG. 10 is a schematic diagram of a cross section taken along line F10-F10 in FIG. 9. FIGS. 11A and 11B are schematic perspective views illustrating the rotating member in the image forming apparatus according to the embodiment.

The operating mechanism 34E is used for raising and lowering the exposure head 33 by the lifting mechanism 34. As illustrated in FIG. 8, the operating mechanism 34E includes a linear motion member 37 (e.g., a translating member), the stepped screw 38, an operation member 39, and a rotating member 35 (e.g., a control member).

The linear motion member 37 has a cylindrical shape that is elongated in the Y direction. A cylindrical-shaped hole 37*a* penetrates from a first end e1 of the linear motion member 37 in the Y1 direction to a second end e2 of the linear motion member 37 in the Y2 direction (e.g., longitudinally through the entire linear motion member 37). A cylindrical surface 37*b* is formed on the outer peripheral portion of the end of the linear motion member 37 in the Y1 direction. The cylindrical surface 37*b* is coaxial with the hole 37*a*. At the end of the cylindrical surface 37*b* in the Y2 direction, a protrusion 37*c* (e.g., a radial protrusion) elongated in the Y direction projects radially outward from the cylindrical surface 37*b*.

A plurality of grooves 37*e* (e.g., notches, recesses, etc.) elongated in the Y2 direction are formed in the outer peripheral portion from the end in the Y2 direction of the cylindrical surface 37*b* to the second end e2 of the linear motion member 37. The intervals between the plurality of grooves 37*e* in the circumferential direction are, for example, equal intervals. Ridges 37*d* radially protruding from the groove bottom of the groove 37*e* are formed between the grooves 37*e* adjacent in the circumferential direction. The distal end surface of each of the ridges 37*d* in the protruding direction has the same outer diameter as the outer diameter of the cylindrical surface 37*b*.

A first engagement portion 36 is provided on an outer peripheral portion of the linear motion member 37 on which the ridge 37*d* is formed. The first engagement portion 36 defines a first engagement surface. The first engagement portion 36 is a protrusion that protrudes radially outward from the ridge 37*d*. The first engagement portion 36 is provided at an intermediate portion in the longitudinal direction on the outer peripheral portion where the ridge 37*d* is formed. The shape of the first engagement portion 36 is not particularly limited as long as the first engagement portion 36 protrudes in the radial direction and has a protrusion shape capable of pressing the rotating member 35 in the Y2 direction. For example, in the present embodiment, the first engagement portion 36 is a column whose central axis extends in the radial direction. The outer diameter of the first engagement portion 36 is not particularly limited as long as the outer diameter of the first engagement portion 36 is strong enough to withstand a load when the rotating member 35 is pressed. For example, in the present embodiment, the outer diameter of the first engagement portion 36 is slightly larger than the circumferential width of the ridge 37*d*.

The stepped screw 38 (e.g., a shoulder bolt) includes a column portion 38*a*, a screw head 38*c*, and a male screw 38*b*. The column portion 38*a* is long in the Y direction. The length of the column portion 38*a* is substantially the same as that of the linear rotation member 37. The outer diameter of the column portion 38*a* is large enough to rotate coaxially with the hole 37*a* of the linear rotation member 37. At the end in the Y1 direction of the column portion 38*a*, the screw head 38*c* having a larger diameter than the column portion 38*a* is formed. The male screw 38*b* is formed coaxially with the column portion 38*a* at the end of the column portion 38*a* in the Y2 direction. The male screw 38*b* can be screwed into the fixing portion 34Af to fixedly couple the stepped screw 37 to the first link 34A.

When the male screw 38*b* is screwed into the fixing portion 34Af in a state of being inserted from the hole 37*a* on the first end e1 side of the linear motion member 37, the stepped screw 38 is fixed into the fixing portion 34Af such that the longitudinal direction of the column portion 38*a* becomes the Y direction. The column portion 38*a* between the fixing portion 34Af and the screw head 38*c* supports the linear motion member 37 rotatably around a central axis O of the column portion 38*a*. The second end e2 of the linear motion member 37 supported by the stepped screw 38 is adjacent to the Y1 direction side of the fixing portion 34Af, as illustrated in FIG. 9.

As illustrated in FIG. 8, the operation member 39 (e.g., a user interface member) includes a cylindrical portion 39*a* (e.g., a main body), a lever 39*b*, and a guide flange 39*c* (e.g., a guide protrusion). The cylindrical portion 39*a* has an inner diameter that can be fitted to the cylindrical surface 37*b* of the linear motion member 37 and the distal end surface of each ridge 37*d*. A U-shaped groove 39*e* long in the Y direction is formed at an end of the cylindrical portion 39*a* in the Y2 direction. The U-shaped groove 39*e* has substantially the same groove width as the circumferential direction of the protrusion 37*c*. When the protrusion 37*c* is inserted into the U-shaped groove 39*e*, the cylindrical portion 39*a* fitted to the cylindrical surface 37*b* is prevented from rotating (e.g., relative rotation is limited) in the circumferential direction of the linear motion member 37. When the cylindrical portion 39*a* is fitted to the linear motion member 37 in a state of being prevented from rotating, the operation member 39 is connected to the linear motion member 37 to be rotatable together around the central axis O.

The lever 39*b* protrudes radially outward from the outer peripheral surface of the cylindrical portion 39*a* in a range from the end of the cylindrical portion 39*a* in the Y1 direction to the middle of the cylindrical portion 39*a*. An appropriate uneven shape is formed on the surface of the lever 39*b* so that the user can easily rotate the operation member 39 by hand.

The guide flange 39*c* protrudes radially outward from the outer peripheral surface of the cylindrical portion 39*a* closer to the Y2 direction than the lever 39*b*. The guide flange 39*c* has a plate shape parallel to the ZX plane. The guide flange 39*c* is rotatably accommodated inside a guide groove 35*g* of the rotating member 35 in a plane parallel to the ZX plane.

The rotating member 35 supports the linear motion member 37 to be rotatable around the central axis O and to be able to advance and retreat in the Y direction (e.g., is slidably and rotatably coupled to the linear motion member 37). The rotating member 35 has an outer shape such that a cylindrical body protrudes in the Y2 direction from a plate-shaped portion parallel to the ZX plane. For example, the rotating member 35 may be manufactured by resin molding. As illustrated in FIG. 10, the rotating member 35 includes a substrate 35*a*, a main body portion 35*b*, and ribs 40 and 41.

The substrate 35*a* has a plate shape parallel to the ZX plane. In the present embodiment, the substrate 35*a* is reinforced in the thickness direction by a plurality of ribs 35*f* protruding in the Y1 direction. The substrate 35*a* is fixed to a side plate (see FIG. 5B) of the support member 34C. The substrate 35*a* includes a screw hole through which a fixing screw is inserted.

As illustrated in FIGS. 11A and 11B, the main body portion 35*b* is connected to (e.g., fixedly coupled to, integrally formed as a single piece with) the substrate 35*a*. The shape of the main body portion 35*b* is a cylindrical shape that protrudes from the substrate 35*a* in the Y2 direction. An inner hole 35*c* or longitudinal aperture penetrating in the Y direction is formed inside the main body portion 35*b*. The inner hole 35*c* also penetrates the substrate 35*a*. The inner surface 35*d* of the inner hole 35*c* is a cylindrical surface whose Y direction is the axial direction. The axial direction, the radial direction, and the circumferential direction of the main body portion 35*b* are a direction along the central axis of the inner hole 35*c*, a direction perpendicular to the central axis, and a direction circling around the central axis, respectively.

The shape of the outer surface 35*j* of the main body portion 35*b* is not particularly limited. For example, the outer surface 35*j* may be a polygonal prism surface, a cylindrical surface, or the like. In the present embodiment, the outer surface 35*j* is a cylindrical surface.

As illustrated in FIG. 11B, a hole 35*i* (e.g., an aperture, a counterbore) is formed on the surface of the substrate 35*a* in the Y1 direction. The hole 35*i* is coaxial with the inner hole 35*c* and has a larger diameter than the inner diameter of the inner hole 35*c*. The depth of the hole 35*i* is shallower than the thickness of the substrate 35*a*. A plurality of ridges 35*k* (e.g., radially-inward protrusions) protruding in the radial direction of the hole 35*i* and extending in the Y direction are formed on the inner wall of the hole 35*i*. The tips of the plurality of ridges 35*k* in the protruding direction collectively define a cylindrical surface having the same diameter as the outer diameter of the cylindrical portion 39*a* of the operation member 39. The hole 35*i* can be inserted so that the tip of the cylindrical portion 39*a* of the operation member 39 can be rotated in the circumferential direction of the hole 35*i*.

As illustrated in FIGS. 11A and 11B, a through-hole 35*e* (e.g., an aperture) is formed in the main body portion 35*b*. The through-hole 35*e* penetrates from the outer surface 35*j* toward the inner surface 35*d*. The schematic shape of the through-hole 35*e* as viewed from the side of the main body portion 35*b* is a spiral shape (e.g., a helix) that turns clockwise as the through-hole 35*e* proceeds in the Y1 direction from an intermediate portion in the axial direction of the main body portion 35*b*. The formation range of the through-hole 35*e* in the circumferential direction of the main body portion 35*b* is, for example, about half a circumference. As illustrated in FIG. 9, the opening width of the through-hole 35*e* in the Y direction is wider than the outer diameter of the first engagement portion 36.

The inner peripheral surface S of the opening formed by the through-hole 35*e* includes plane portions S1 and S2, a spiral portion S3 (e.g., an inclined portion), plane portions S4, S5 (see FIG. 11B), and S6 (see FIG. 11A), and an inclined surface portion S7 (see FIG. 11A). The inner peripheral surface S is a planar or a curved surface orthogonal to the inner surface 35*d*. As illustrated in FIG. 11B, the plane portion S1 is a plane parallel to the radial direction and the axial direction of the main body portion 35*b*. The plane portion S2 is a plane extending in the circumferential direction of the main body portion 35*b*, and is parallel to the ZX plane. The plane portion S2 is smoothly (e.g., continuously) connected to the end of the plane portion S1 in the Y2 direction via an arcuate curved surface. The plane portion S2 extends clockwise with respect to the plane portion S1 when viewed from the Y1 direction.

The spiral portion S3 is smoothly connected to the end of the plane portion S2 opposite to the plane portion S1 via an arcuate curved surface. The spiral portion S3 has a length in the Y direction and a circumferential direction around the central axis O. In the present embodiment, the spiral portion S3 is a spiral (e.g., helical, inclined) surface that turns clockwise as the spiral portion S3 advances in the Y1 direction.

The plane portion S4 is a plane extending in the circumferential direction of the main body portion 35*b*, and is parallel to the ZX plane (e.g., perpendicular to the Y direction). The plane portion S4 is smoothly connected to the end of the spiral portion S3 in the Y1 direction via an arcuate curved surface. The plane portion S4 extends clockwise with respect to the spiral portion S3 when viewed in the Y1 direction. The plane portion S4 is formed at a position separated from the surface in the Y2 direction of the substrate 35*a* in the Y2 direction.

The plane portion S5 is a plane parallel to the radial direction and the axial direction of the main body portion 35*b*. The plane portion S5 is smoothly connected to the end of the plane portion S4 opposite to the spiral portion S3 via an arcuate curved surface. The end in the Y1 direction of the plane portion S5 is located at an intermediate portion in the thickness direction of the substrate 35*a*. The plane portion S5 intersects the bottom surface of the hole 35*i*.

As illustrated in FIG. 11A, the plane portion S6 is a plane extending in the circumferential direction of the main body portion 35*b*, and is parallel to the ZX plane. The plane portion S6 is smoothly connected to the end in the Y1 direction of the plane portion S1 via an arcuate curved surface. The plane portion S6 extends clockwise with respect to the plane portion S1 when viewed from the Y1 direction.

The inclined surface portion S7 is smoothly connected to the end of the plane portion S6 opposite to the plane portion S1 via an arcuate curved surface. The inclined surface portion S7 is an inclined surface that is inclined clockwise as the inclined surface portion S7 advances in the Y1 direction. The inclined surface portion S7 has substantially the same inclination as the spiral portion S3 opposed in the Y direction. For example, the inclined surface portion S7 may be a spiral surface similar to the spiral portion S3. The end in the Y1 direction of the inclined surface portion S7 is smoothly connected to the surface in the Y2 direction of the substrate 35*a* via an arcuate curved surface.

As illustrated in FIGS. 11A and 11B, the rib 40 protrudes outward from an outer surface 35*j*. In the present embodiment, the rib 40 has a flat plate shape parallel to the radial direction and the axial direction of the rotating member 35. The rib 40 is elongated in the Y direction, which is the axial direction of the main body portion 35*b*. In the present embodiment, the rib 40 is a protrusion on the outer surface 35*j* and has a plate thickness equal to or less than the plate thickness of the main body portion 35*b* (i.e., the distance between the outer surface 35*j* and an inner surface 35*d*). The height of the rib 40 from the outer surface 35*j* is higher than the plate thickness of the main body portion 35*b*. The end of the rib 40 in the Y1 direction is connected to the surface of the substrate 35*a* in the Y2 direction. The rib 40 is provided to straddle the substrate 35*a* and the main body portion 35*b*. In particular, when viewed from the radial direction of the main body portion 35*b*, the rib 40 crosses the spiral portion S3 and straddles the through-hole 35*e*. However, the end surface of the rib 40 in the Y1 direction on the through-hole 35*e* is formed at a height that does not interfere with the tip of the first engagement portion 36 passing through the through-hole 35*e*. As illustrated in FIG. 10, when viewed from the Y1 direction, the ribs 40 straddle the gap between the outer surface 35*j* and the inner wall of the hole 35*i* and connect the main body portion 35*b* and the substrate 35*a*. As illustrated in FIG. 11A, the tip of the rib 40 in the Y2 direction protrudes from the plane portion S2 in the Y2 direction. In the example illustrated in FIG. 11A, the tip of the rib 40 in the Y2 direction reaches near the tip of the substrate 35*a* in the Y2 direction. An inclined portion 40*a* that is separated from the outer surface 35*j* as the inclined portion 40*a* advances in the Y1 direction is formed at the tip of the rib 40 in the Y2 direction.

As illustrated in FIGS. 11A and 11B, the rib 41 protrudes outward from the outer surface 35*j*. In the present embodiment, the rib 41 has a flat plate shape parallel to the radial direction and the axial direction of the rotating member 35. The rib 41 is elongated in the Y direction, which is the axial direction of the main body portion 35*b*. The end of the rib 41 in the Y1 direction is connected to the surface of the substrate 35*a* in the Y2 direction. The rib 41 is provided to straddle the substrate 35*a* and the main body portion 35*b*. In the present embodiment, the position of the tip of the rib 41 in the Y2 direction is the same as that of the rib 40. An inclined portion 41*a* similar to the inclined portion 40*a* of the rib 40 is formed at the tip of the rib 41 in the Y2 direction.

The rib 41 is separated from the rib 40 in the circumferential direction of the main body portion 35*b*. In the present embodiment, the rib 41 is provided at a position near the plane portion S1 and offset from the plane portion S1 in the counterclockwise direction when viewed from the Y1 direction. In the example illustrated in FIG. 10, the ribs 40 and 41 are formed at positions facing each other in the radial direction of the main body portion 35*b*.

As illustrated in FIGS. 11A and 11B, the rotating member 35 is provided with a guide wall 35*h* on the surface of the substrate 35*a* in the Y1 direction. The guide wall 35*h* is provided outside the hole 35*i* when viewed from the Y2 direction. The guide wall 35*h* includes a side wall portion 35*h*1 protruding from the substrate 35*a* in the Y1 direction, and a rear wall portion 35*h*2 protruding in the X2 direction from the end in the Y1 direction of the side wall portion. The gap between the side wall portion 35*h*1 and the substrate 35*a* is wider than the thickness in the Y direction of the guide flange 39*c* of the operation member 39. The distance from the central axis of the main body portion 35*b* to the rear wall portion 35*h*2 is longer than the radius of the guide flange 39*c* around the central axis O (see FIG. 9). A guide groove 35*g* into which the guide flange 39*c* of the operation member 39 can be inserted and which can rotate around the central axis O is formed between the guide wall 35*h* and the substrate 35*a*.

As illustrated in FIGS. 9 and 10, in the operating mechanism 34E, the linear motion member 37 is held adjacent to the fixing portion 34Af, and is inserted into the inner hole 35*c* (see FIG. 10) of the main body portion 35*b*. The first engagement portion 36 is inserted inside the through-hole 35*e*. The operation member 39 has the guide flange 39*c* inserted into the guide groove 35*g*, and is fitted to the end in the Y1 direction of the linear motion member 37 at the tip in the Y2 direction of the cylindrical portion 39*a*. The lever 39*b* of the operation member 39 is adjacent to the Y1 direction side of the substrate 35*a* of the rotating member 35. The operation member 39 is retained in the guide groove 35*g* in the Y direction (e.g., limit movement of the operation member 39 in the Y direction). Since the linear motion member 37 is rotatably supported around the central axis O by the stepped screw 38 (see FIG. 10) and the protrusion 37*c* of the linear motion member 37 is received within the u-shaped groove 39*e* of the operation member 39, the linear motion member 37 rotates together with the operation member 39 in the main body portion 35*b* when the operation member 39 rotates around the central axis O.

The operation of the image forming apparatus 100 will be described. First, an image forming operation of the image forming apparatus 100 will be briefly described. As illustrated in FIG. 1, in the image forming apparatus 100, each exposure unit 26 is mounted on the base 11 in the printer unit 3 such that the exposure head 33 is in the contact position. At the contact position, the focal position of the lens is aligned with the surface of the photosensitive drum 7. Image formation is started by the operation of the control panel 1 or an external signal. The image information is sent to the printer unit 3 after a copy object is read by the scanner unit 2, or the image information is sent to the printer unit 3 from an external source (e.g., a computer). The printer unit 3 supplies the sheet P in the sheet feeding unit 4 or the sheet P in the manual feeding unit 10 to the registration roller 24 based on a control signal generated by the control unit 6 based on an operation of the control panel 1 or an external signal. When an operation input for image formation is made from the control panel 1, the control unit 6 performs, for example, control to start the feeding of the sheet P and image formation.

Each exposure unit 26 exposes respective photosensitive drums 7 of the image forming units 25Y, 25M, 25C, and 25K based on the image information corresponding to each color sent from the control unit 6, and forms electrostatic latent images corresponding to each image information. Each electrostatic latent image is developed by the developing device 8. Therefore, toner images corresponding to the electrostatic latent images are formed on the surface of each photosensitive drum 7. Each toner image is primarily transferred to the intermediate transfer belt 27 by each transfer roller. As the intermediate transfer belt 27 moves, each of the toner images is sequentially superimposed without causing a color shift and is sent to the transfer unit 28. The sheet P is fed from the registration roller 24 to the transfer unit 28. The toner image that has reached the transfer unit 28 is secondarily transferred to the sheet P. The secondary-transferred toner image is fixed on the sheet P by the fixing device 29. Thus, an image is formed on the sheet P.

In the image forming apparatus 100, the photosensitive drum unit 25D may need to be pulled out of the apparatus for maintenance in some cases. In this case, the user operates the operating mechanism 34E to move the exposure head 33 of the exposure unit 26 corresponding to the image forming unit 25 to be pulled out to the separated position, and then pulls out the photosensitive drum unit 25D. By moving the exposure head 33 to the separated position, the exposure head 33 may be positioned to provide clearance between the exposure head 33 and other components to thereby permit or facilitate removal and replacement of the image forming unit 25 without interference. Hereinafter, the operation of the lifting mechanism 34 and the operating mechanism 34E will be described focusing on the action of the operating mechanism 34E.

As illustrated in FIG. 6, when the exposure head 33 is at the contact position, the lifting mechanism 34 moves up in the Z1 direction with respect to the support member 34C. In the present embodiment, the exposure head 33 connected to the first engagement shaft 34Baa of each second link 34Ba rises by the action of the link mechanism 34B that raises each second link 34Ba from a nearly horizontal state. In order to raise the second link 34Ba in the link mechanism 34B, as illustrated in FIG. 4, the positions in the Y direction of the engagement shaft 34Bbb of the third link 34Bb and the third engagement shaft 34Bac of the second link 34Ba may be made close to each other. In the present embodiment, since the engagement shaft 34Bbb is engaged with the support portion 34Cc of the support member 34C, the third engagement shaft 34Bac connected to the first link 34A is moved in the Y2 direction.

As illustrated in FIG. 6, the user turns the lever 39*b* of the operation member 39 clockwise as viewed from the Y2 direction with respect to the central axis O to a rotation limit (hereinafter, an ascended position). The first link 34A is towed by the biasing member 34D to move in the Y2 direction. In the ascended position of the operation member 39, as illustrated in FIGS. 9 and 10, the first engagement portion 36 is in contact with the plane portion S1. The first engagement portion 36 is separated from the plane portions S2 and S6 in the Y direction, and is located between the plane portions S2 and S6. The first engagement portion 36 presses the plane portion S1 in the circumferential direction, and does not press the main body portion 35*b* in the Y direction. The first link 34A stops at a position where the exposure head 33 balances the force in the Y1 direction applied by the pressing force by the spacers 25*d*F and 25*d*R through the link mechanism 34B and the traction force in the Y2 direction applied by the biasing member 34D.

Figure 13:
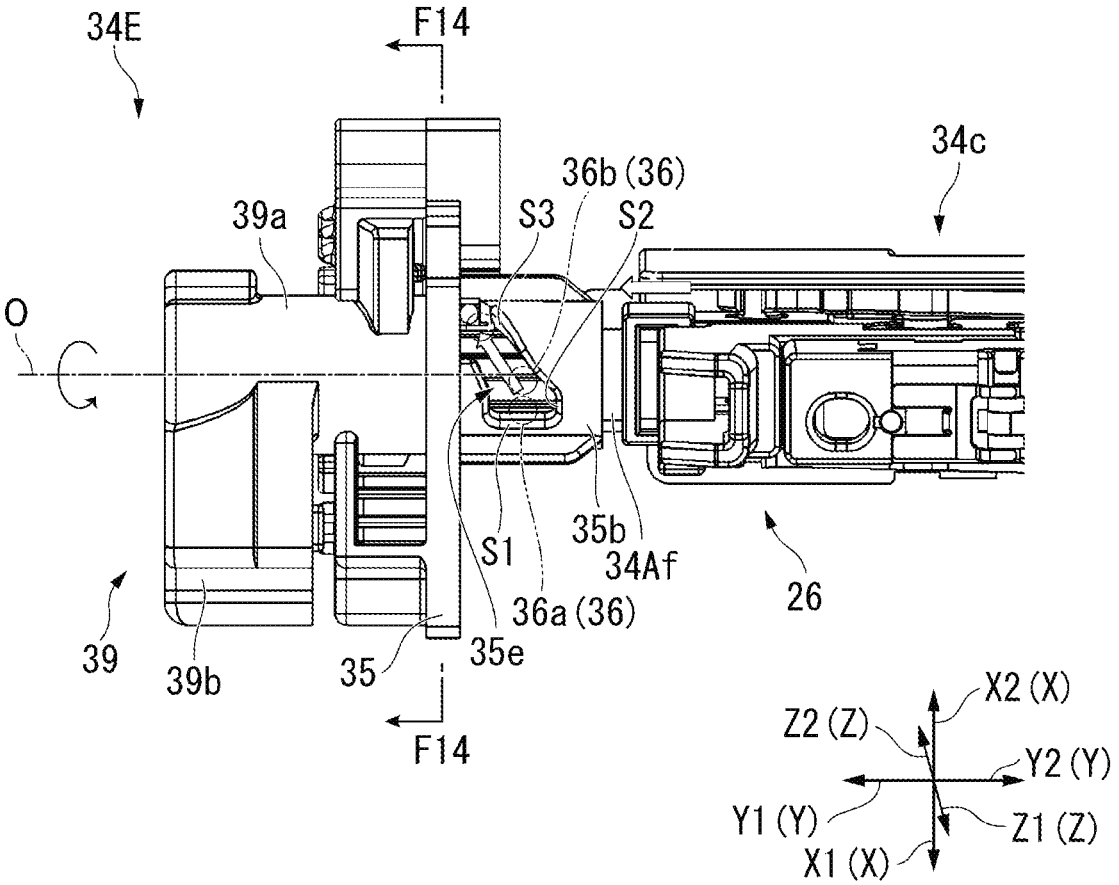
FIG. 13 is a schematic perspective view illustrating the operating mechanism of FIG. 7 at the separated position.
Figure 14:
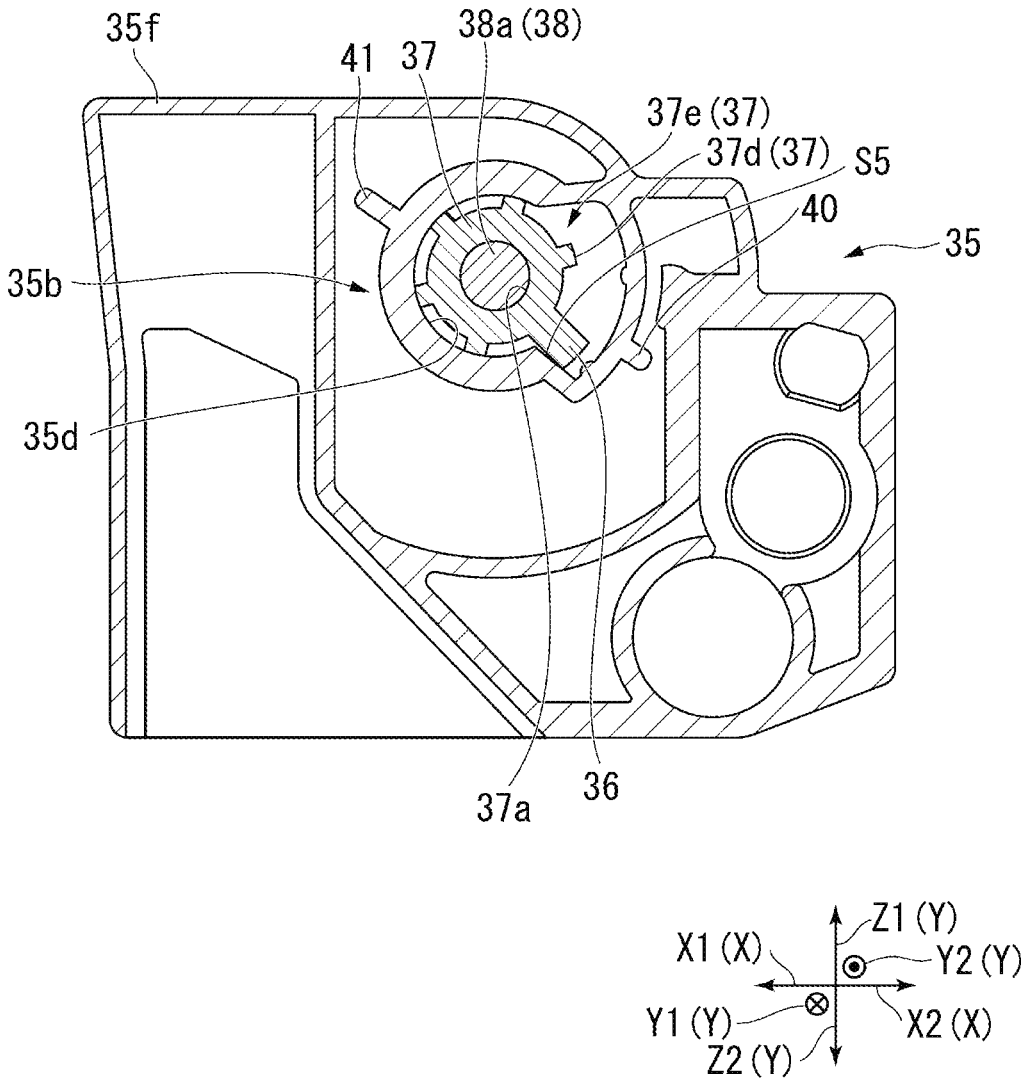
FIG. 14 is a schematic view of a cross section taken along line F14-F14 in FIG. 13.

The operation of lowering the exposure head 33 from the contact position to the separated position will be described. FIG. 12 is a schematic perspective view of the exposure unit and the lifting mechanism at the separated position in the image forming apparatus according to the embodiment. FIG. 13 is a schematic perspective view illustrating the operating mechanism at the separated position in the image forming apparatus according to the embodiment. FIG. 14 is a schematic view of a cross section taken along line F14-F14 in FIG. 13.

As illustrated in FIG. 12, the user turns the lever 39*b* of the operation member 39 counterclockwise as viewed from the Y2 direction with respect to the central axis O to a rotation limit (hereinafter, referred to as a descended position). As illustrated in FIG. 13, the linear motion member 37 rotates counterclockwise when viewed from the Y2 direction with the rotation of the operation member 39. Since a plurality of ridges 37*d* are formed on the outer surface of the linear motion member 37, the contact area between the inner surface 35*d* of the main body portion 35*b* and the outer surface of the linear motion member 37 is reduced compared to the case where the outer surface of the linear motion member 37 is a cylindrical surface, and the smooth rotation is possible.

At the ascended position, the first engagement portion 36 is in contact with the plane portion S1 like the first engagement portion 36*a* schematically illustrated by a two-dot chain line. As the linear motion member 37 rotates, the first engagement portion 36 moves in the circumferential direction (i.e., the direction from the bottom to the top in FIG. 13) and comes into contact with the spiral portion S3, like the first engagement portion 36*b* schematically illustrated by a two-dot chain line.

As illustrated in FIG. 11B, when the linear motion member 37 further rotates in the spiral portion S3, the first engagement portion 36*b* moves in the circumferential direction along the spiral portion S3 as illustrated by a white outline in the drawing, and moves in the Y1 direction. Since the end of the linear motion member 37 in the Y1 direction is locked to the stepped screw 38, the first link 34A moves in the Y1 direction via the stepped screw 38. The biasing member 34D is extended in the Y1 direction with the movement of the first link 34A, and the elastic restoring force in the Y2 direction increases.

The linear motion member 37 and the first engagement portion 36 provided on the linear motion member 37 are biased by the biasing member 34D in the Y2 direction away from the substrate 35*a*. The first engagement portion 36 can press the inner peripheral surfaces S on the Y2 direction side, for example, the plane portion S2, the spiral portion S3, and the plane portion S4 in the Y2 direction. Since the ascending limit of the exposure head 33 in the image forming apparatus 100 is regulated by the spacers 25*d*R and 25*d*F, the inner peripheral surfaces S pressed by the first engagement portion 36 in the Y2 direction in the image forming apparatus 100 are the spiral portion S3 and the plane portion S4. The spiral portion S3 and the plane portion S4 are examples of the second engagement portion (e.g., a second engagement surface) that engages with the first engagement portion 36 in the Y2 direction. The second engagement portion regulates the amount of movement of the linear motion member 37 in the direction along the central axis O to a predetermined moving distance by engaging with the first engagement portion 36. In particular, the plane portion S4 defines the moving distance of the linear motion member 37 at the separated position. The Y2 direction in the present embodiment is an example of a first direction away from the substrate.

The elastic restoring force of the biasing member 34D acts on the spiral portion S3 via the first engagement portion 36 in the Y2 direction. For example, a force Fb in the Y2 direction acts on the spiral portion S3 from the first engagement portion 36*b*. A vertical component force Fb1 and a parallel component force Fb2 of the force Fb act on the spiral portion S3. The vertical component force Fb1 is an external force that pulls the spiral portion S3 in a direction away from the substrate 35*a*. The parallel component force Fb2 becomes a resistance force in the moving direction of the first engagement portion 36*b*.

When the rotation of the linear motion member 37 further advances, the first engagement portion 36 further moves in the Y1 direction, and the first engagement portion 36 comes into contact with the plane portion S4, like the first engagement portion 36*c* schematically illustrated by a two-dot chain line. A force Fc directed in the Y2 direction acts on the plane portion S4 in response to the elastic restoring force of the biasing member 34D which is increased as compared with the time of contact with the spiral portion S3. The force Fc is an external force that pulls the plane portion S4 from the substrate 35*a* in the Y2 direction.

When the linear motion member 37 is further rotated, as illustrated in FIG. 14, the first engagement portion 36 comes into contact with the plane portion S5, and the operation member 39 reaches the descended position. Since the first engagement portion 36 is locked to the plane portion S4 in the Y direction, the operation member 39 and the linear motion member 37 maintain the descended position even if the user releases the hand from the lever 39*b*. Thus, when the operation member 39 moves to the descended position, the first link 34A moves most in the Y1 direction on the support portion 34Cc. As illustrated in FIGS. 5A and 5B, the distance in the Y direction between the engagement shaft 34Bbb of the third link 34Bb and the third engagement shaft 34Bac of the second link 34Ba increases. As illustrated in FIG. 12, each second link 34Ba comes closer to the horizontal from the standing state. The exposure head 33 connected to the first engagement shaft 34Baa of each second link 34Ba descends to the separated position.

Figure 15:
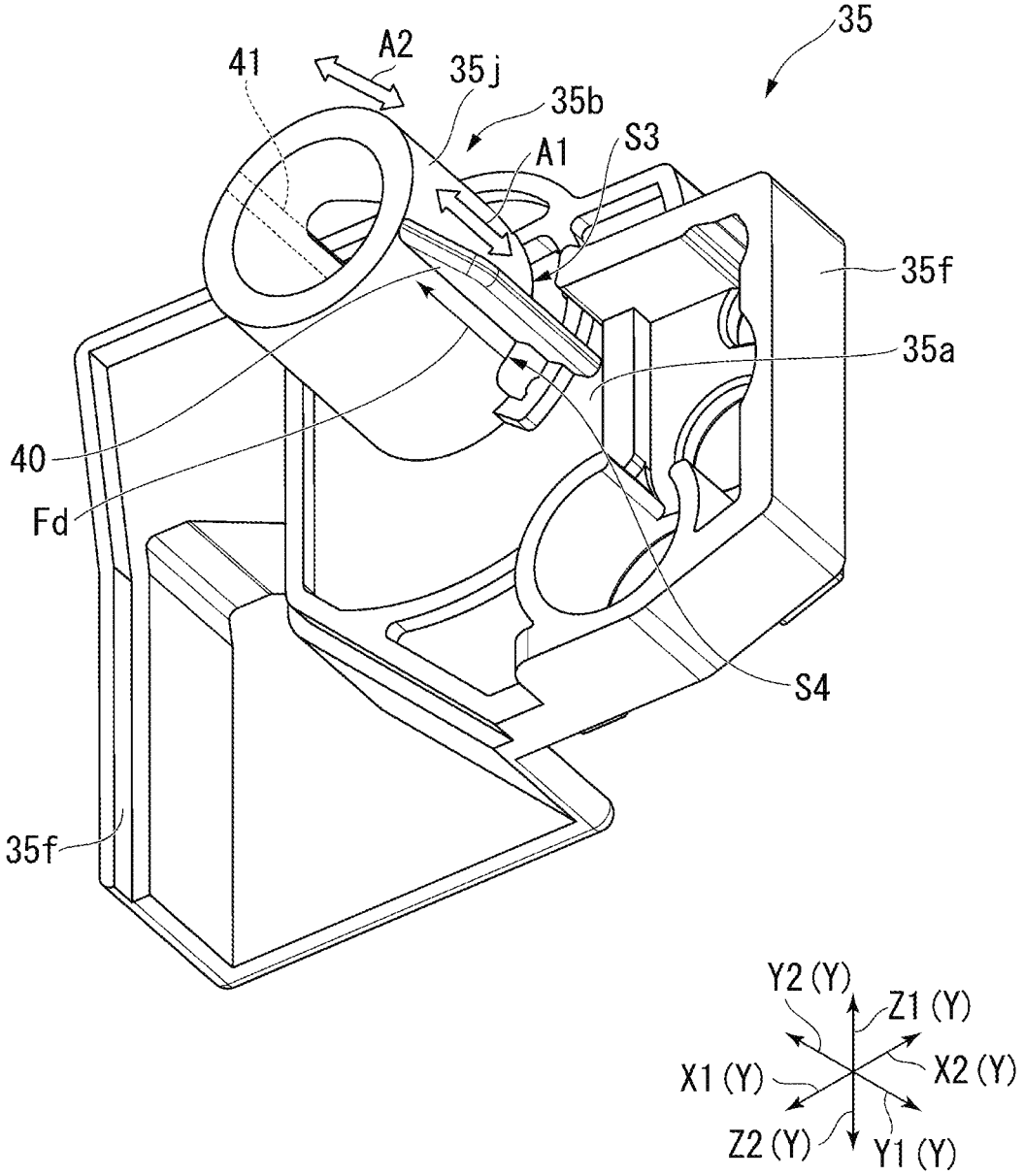
FIG. 15 is a schematic perspective view illustrating the action of the rotating member of FIG. 11A.

The height of the exposure head 33 from the bottom surface portion 34Ca at the separated position depends on the inclination angle of each second link 34Ba with respect to the horizontal plane. The inclination angle of each second link 34Ba corresponds to the movement position of the first link 34A in the Y direction. As an error factor of the movement position of the first link 34A, for example, a deformation of the rotating member 35 can be mentioned. FIG. 15 is a schematic perspective view illustrating the action of the rotating member in the image forming apparatus according to the embodiment.

The first link 34A moves most in the Y1 direction when the first engagement portion 36 is locked to the plane portion S4. The plane portion S4 defines the position of the first link 34A in the Y direction at the separated position. Since the substrate 35*a* is fixed to the side plate of the support member 34C, the position of the substrate 35*a* in the Y direction is constant. For example, when the plane portion S4 moves in the Y2 direction due to the deformation of the main body portion 35*b*, this movement amount becomes a positional error in the Y direction of the first link 34A. In the plane portion S4, the fact that the force acting on the main body portion 35*b* from the first engagement portion 36 through the inner peripheral surface S reaches the maximum value Fc also maximizes the deformation of the main body portion 35*b*, and the spiral portion S3 and the plane portion S4 in the main body portion 35*b*.

In the present embodiment, as illustrated in FIG. 15, the rib 40 connects the substrate 35*a* and the outer surface 35*j* of the main body portion 35*b*. The rib 40 functions as a reinforcing material that increases the rigidity of the main body portion 35*b* in the Y direction. The rib 40 increases the cross-sectional area of the main body portion 35*b* in a cross section parallel to the ZX plane. The rib 40 increases the second moment of area in a cross section of the main body portion 35*b* parallel to the ZX plane. Specifically, the tensile rigidity of the main body portion 35*b* in the Y2 direction is increased by the rib 40 (see the arrow A1 in FIG. 15). The rib 40 increases the bending rigidity of the main body portion 35*b* in the direction in which the rib 40 is arranged (see the arrow A2 in FIG. 15). The rib 40 reduces the deformation of the spiral portion S3 and the plane portion S4 by reinforcing the main body portion 35*b*. The rib 40 is connected to the substrate 35*a* that is fixed to the side plate of the support member 34C and is not easily deformed. The fact that the main body portion 35*b* is integrally fixed to (e.g., integrally formed as a single continuous piece with) the substrate 35*a* that is not easily deformed via the rib 40 also resists the deformation of the main body portion 35*b*. In particular, since the rib 40 connects the main body portion 35*b* and the substrate 35*a* in the Y direction across the through-hole 35*e*, the size of the opening of the through-hole 35*e* is prevented from increasing in the Y direction near the rib 40. When the expansion of the opening of the through-hole 35*e* is prevented, the deformation of the spiral portion S3 and the plane portion S4 is also reduced. In the present embodiment, the rib 40 is provided near (e.g., adjacent to) the plane portion S4. The plane portion S4 is a position on the inner peripheral surface S where the first engagement portion 36 is closest to the substrate 35*a*, and is a position where the traction force from the biasing member 34D is maximum. With such an arrangement, the rib 40 can efficiently prevent the deformation of the main body portion 35*b*, particularly, an increase in the distance between the spiral portion S3 and the plane portion S4, and the substrate 35*a*.

In the present embodiment, the rotating member 35 includes the rib 41 in addition to the rib 40. The rib 40 and the rib 41 may be integrally formed as a single continuous piece with the main body portion 35*b* and the substrate 35*a*. Similar to the rib 40, the rib 41 is formed to extend in the Y direction across the outer surface 35*j* of the main body portion 35*b* and the substrate 35*a*, and increases the cross-sectional area and the second moment of area of the main body portion 35*b*. According to the rib 41, the tensile rigidity and the bending rigidity of the main body portion 35*b* are increased as compared with the case where the rib 41 is not provided. In particular, in the present embodiment, since the ribs 41 and 40 are provided at positions corresponding to each other with the main body portion 35*b* interposed therebetween, the bending rigidity in the facing direction is remarkably improved. Since the spiral portion S3 is sandwiched between the ribs 41 and 40 in the circumferential direction of the main body portion 35*b*, the deformation of the spiral portion S3 between the ribs 41 and 40 is remarkably prevented.

In particular, since the rib 41 is provided near the plane portion S1, the deformation of the inner peripheral surfaces S near the plane portion S1 can be efficiently prevented. The ribs that reinforce the main body portion 35*b* are not limited to the ribs 40 and 41, and may be provided in appropriate positions and in appropriate numbers. For example, the rib 41 does not straddle the through-hole 35*e*, but can prevent the deformation of the inner peripheral surface S near the arrangement position. For example, the rib that reinforces the main body portion 35*b* may be formed only by the rib that is disposed near the inner peripheral surface S and does not straddle the through-hole 35*e*.

Figure 16:
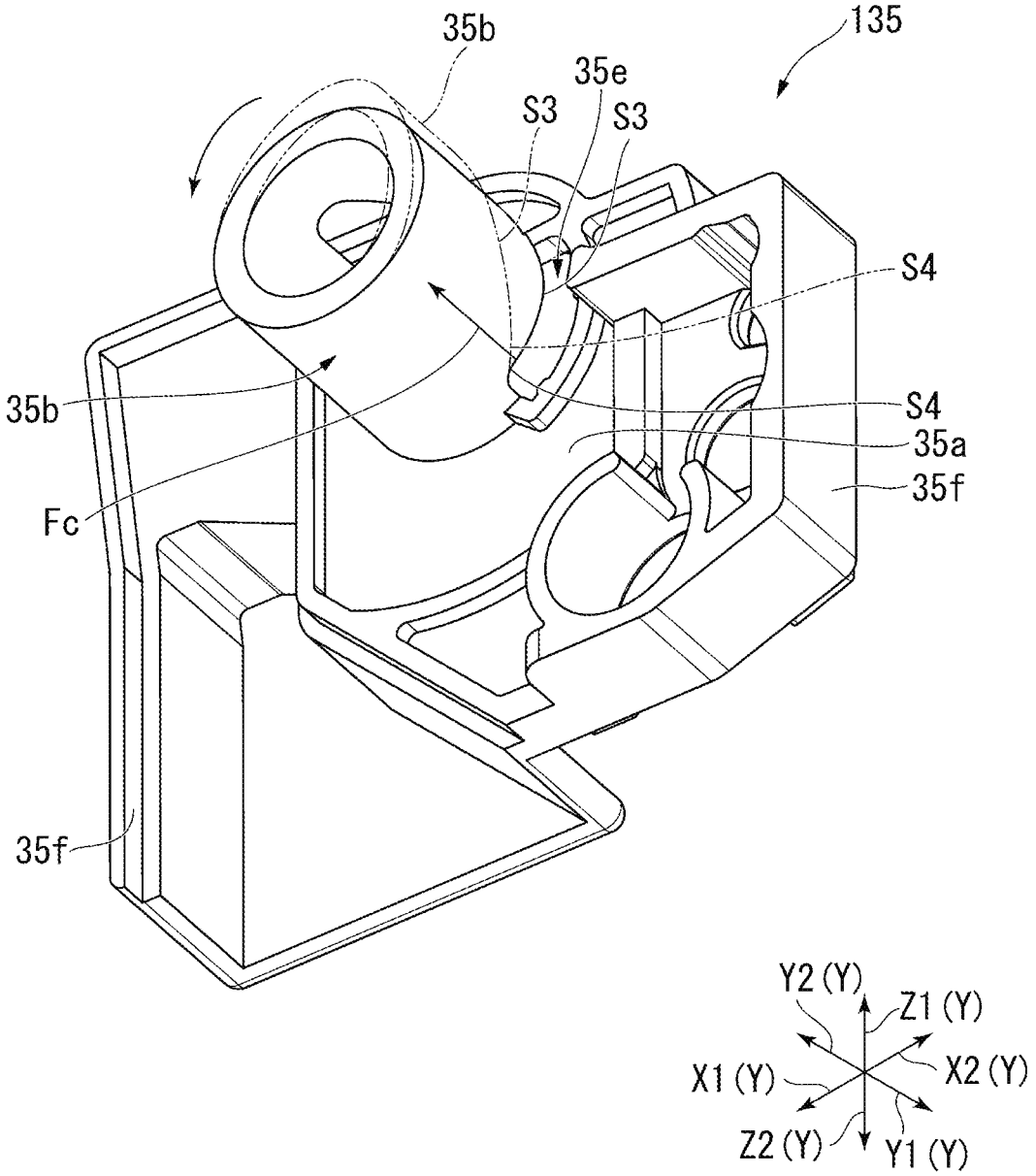
FIG. 16 is a schematic perspective view illustrating the action of a rotating member of a comparative example.

The action of the ribs 40 and 41 will be described in comparison with a comparative example. FIG. 16 is a schematic perspective view illustrating the action of the rotating member of the comparative example. A rotating member 135 of the comparative example illustrated in FIG. 16 has the same configuration as the rotating member 35 of the embodiment except that the ribs 40 and 41 are not provided. When the rotating member 135 is used instead of the rotating member 35 of the operating mechanism 34E according to the embodiment, the force Fc acts on the plane portion S4 at the descended position of the operation member 39 as in the embodiment. Since the main body portion 35*b* of the comparative example is not reinforced by the ribs 40 and 41, the main body portion 35*b* of the comparative example is more easily deformed by the force Fc than the rotating member 35. For example, as illustrated by a two-dot chain line in FIG. 16, the plane portion S4 and the spiral portion S3 are deformed by the force Fc in a direction away from the substrate 35*a* in the Y2 direction. Particularly, since the deformation of the plane portion S4 in the Y2 direction is significantly larger than that of the rotating member 35, an error in the amount of movement in the Y direction in the rotating member 35 and the first link 34A locked to the rotating member 35 occurs in correspondence to the amount of deformation. The error in the amount of movement is a deviation from the moving distance defined by the spiral portion S3 and the plane portion S4. Since the descending amount of the exposure head 33 at the separated position becomes smaller than the design value due to the error in the amount of movement, the gap between the exposure head 33 and the case 25A is reduced. For example, when the photosensitive drum unit 25D is pulled out, the exposure head 33 may interfere with the photosensitive drum unit 25D. For example, at the time of cleaning the exposure head 33, there is a possibility that cleaning of the exposure head 33 becomes difficult because a gap into which a cleaning tool can be inserted is narrow.

As described above, since the rotating member 35 includes the ribs 40 and 41, the deformation of the main body portion 35*b* is prevented or reduced, and the positional error of the plane portion S4 in the first direction with respect to the substrate 35*a* is reduced. As a result, it is possible to prevent the exposure head 33 from being properly lowered to the predetermined separated position. For example, it is possible to prevent the exposure head 33 from interfering with the photosensitive drum unit 25D when the photosensitive drum unit 25D is pulled out. For example, at the time of cleaning the exposure head 33, a gap for inserting a cleaning tool can be ensured, so that the cleaning of the exposure head 33 becomes easy.

As described above, according to the image forming apparatus 100 of the present embodiment, since the rotating member 35 includes the ribs 40 and 41, the deformation of the main body portion 35*b* can be prevented, and the height of the exposure head 33 at the separated position can be prevented. According to the present embodiment, the photosensitive drum unit 25D can be easily pulled out at the separated position of the exposure head 33, and the exposure head 33 can be easily cleaned. According to the present embodiment, it is possible to provide the image forming apparatus 100 in which the maintenance of the photosensitive drum unit 25D and the exposure head 33 is easy.

Hereinafter, modifications of the above-described embodiments will be described. In the embodiment, it has been described that the rotating member 35 includes the ribs 40 and 41. Since the ribs 40 and 41 can independently reinforce the main body portion 35*b*, the rotating member 35 does not need to have one of the ribs 40 and 41 when the required strength as the main body portion 35*b* is obtained.

In the embodiment, it has been described that the ribs 40 and 41 have a plate shape thinner than the plate thickness of the main body portion 35*b* and longer than the plate thickness. The ribs 40 and 41 may be formed thicker than the plate thickness of the main body portion 35*b*, or may be formed shorter than the plate thickness of the main body portion 35*b*, as long as the necessary reinforcing strength and formability are obtained. The ribs 40 and 41 include a rib structure in resin molding, and also include a protrusion in a wider sense than the rib structure in resin molding. For example, the tip of the rib 40 in the Y2 direction may have a curved shape instead of the inclined portion 40*a*, or may have a cornered shape. For example, the ribs 40 and 41 may not be plate-shaped. For example, the ribs 40 and 41 may be triangular protrusions whose thickness decreases as the ribs 40 and 41 advance in the Y2 direction when viewed from the radial direction. For example, the cross section of the ribs 40 and 41 parallel to the ZX plane is not limited to a rectangle or a trapezoid, but may be a semicircle, a parabola or the like. For example, when the cross-sectional shape parallel to the ZX plane of the outer surface 35*j* of the main body portion 35*b* is formed in a polygonal shape, the ribs 40 and 41 may be configured with thick portions at the outwardly convex corners.

In the embodiment, it has been described that the ribs 40 and 41 are provided at positions facing each other across the main body portion 35*b*. The gap between the ribs 40 and 41 is not particularly limited as long as the necessary reinforcing strength and formability can be obtained. For example, the ribs 40 and 41 may be formed to approach in the circumferential direction. In this case, a connecting rib may be formed between the ribs 40 and 41 adjacent to each other to connect each other in the circumferential direction. In this way, a plurality of ribs arranged in parallel or a plurality of ribs arranged in parallel and connected to each other further increase the reinforcing effect as compared with a single rib.

In the embodiment, the rotating member 35 has been described as being formed such that the ribs 40 and 41 extend in the axial direction of the main body portion 35*b*. The ribs 40 and 41 may extend in a direction inclined with respect to the axial direction of the main body portion 35*b* as long as necessary reinforcing strength and formability are obtained. For example, the ribs 40 and 41 may be formed in a zigzag shape as the ribs 40 and 41 advance in the Y2 direction. For example, the ribs 40 and 41 may be provided along the inner peripheral surface S of the through-hole 35*e*.

In the embodiment, the description has been given assuming that the main body portion 35*b* is cylindrical. The main body portion is not limited to a cylindrical shape. For example, the main body portion may be a flat plate, a cylindrical and inner curved plate, or the like.

In the embodiment, it has been described that the rotating member 35, the first engagement portion 36, and the linear motion member 37 are used for the lifting mechanism 34 that raises and lowers the exposure head 33. The lifting mechanism is not limited to the lifting mechanism that raises and lowers the exposure head 33. For example, the lifting mechanism may be a lifting mechanism that raises and lowers an intermediate transfer belt unit including the intermediate transfer belt 27.

In the embodiment, it has been described that the lifting mechanism 34 raises and lowers the exposure head 33 in the Z direction. When the optical axis of the exposure head 33 is not along the vertical plane, the lifting mechanism 34 may move the exposure head 33 in an appropriate direction according to the optical axis of the exposure head 33. For example, the optical axis of the exposure head 33 may be along a horizontal plane, and in this case, the rotating member 35, the first engagement portion 36, and the linear motion member 37 may be used as a horizontal moving mechanism.

According to at least one embodiment described above, it is possible to provide an image forming apparatus allowing the maintenance of the photosensitive drum unit and the exposure head to be easy since the image forming apparatus includes an operating mechanism including a linear motion member that includes a first engagement portion and moves along an axis that is elongated in a first direction; a rotating member that includes a second engagement portion engaging with the first engagement portion in the first direction and regulates the amount of movement of the linear motion member along the axis by the second engagement portion to a predetermined moving distance; and a rib that reinforces the rotating member in order to reduce the deformation of the second engagement portion and prevent the error in the amount of movement with respect to the moving distance.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An operating mechanism for an image forming apparatus, the image forming apparatus including a photosensitive body and an exposure head configured to emit light onto a surface of the photosensitive body, the operating mechanism comprising:

a translating member defining a first engagement surface and configured to both (a) move along an axis that extends in a first direction and (b) be coupled to at least one of the photosensitive body and the exposure head such that movement of the translating member along the axis controls a distance between the photosensitive body and the exposure head;

a rotating member coupled to the translating member such that the translating member is both (a) movable relative to the rotating member along the axis and (b) rotatable relative to the rotating member about the axis, the rotating member defining a second engagement surface configured to engage the first engagement surface to regulate movement of the translating member such that a rotational displacement of the translating member about the axis has a corresponding linear displacement of the translating member along the axis; and a rib coupled to the rotating member and configured to reinforce the rotating member in order to resist deformation of the rotating member caused by engagement of the first engagement surface with the second engagement surface.

2. The operating mechanism of claim 1, further comprising a user interface member slidably coupled to the translating member and rotatably coupled to the rotating member, wherein the user interface member is configured to control rotation of the translating member about the axis.

3. The operating mechanism of claim 2, wherein:

the user interface member includes a main body configured to rotate about the axis and a guide protrusion extending radially outward from the main body; and the rotating member defines a guide groove configured to receive the guide protrusion to limit movement of the user interface member along the axis.

4. The operating mechanism of claim 1, further comprising a biasing member configured to apply a biasing force to bias the translating member, wherein:

the rotating member includes both (a) a main body portion that defines the second engagement surface and (b) a substrate directly coupled to the main body portion; and the biasing force biases the first engagement surface in the first direction away from the substrate and against the second engagement surface.

5. The operating mechanism of claim 4, wherein the rib is elongated in the first direction, and the rib is directly coupled to and extends between the substrate and the main body portion.

6. The operating mechanism of claim 5, wherein:

the main body portion defines a through-hole having an inner peripheral surface including the second engagement surface; and the rib extends across the through-hole.

7. The operating mechanism of claim 6, wherein:

the main body portion has a cylindrical outer surface and a cylindrical inner surface;

the through-hole extends radially from the cylindrical inner surface to the cylindrical outer surface; and the first direction extends axially along the main body portion.

8. The operating mechanism of claim 7, wherein:

the second engagement surface includes a spiral portion that extends at least partially around the axis; and the translating member engages the cylindrical inner surface and is movable axially along the second engagement surface during rotation.

9. The operating mechanism of claim 4, wherein a distance between the second engagement surface and the substrate varies along the second engagement surface, and the rib extends adjacent a portion of the second engagement surface where the distance between the second engagement surface and the substrate is smallest.

10. The operating mechanism of claim 4, wherein the rib, the substrate, and the main body portion are integrally formed as a single continuous piece.

11. The operating mechanism of claim 1, wherein the second engagement surface includes an inclined portion and a planar portion, the planar portion extending substantially perpendicular to the axis.

12. The operating mechanism of claim 11, further comprising a biasing member configured to bias the first engagement surface into engagement with the second engagement surface, and wherein, when the first engagement surface engages the inclined portion, the biasing member is configured to bias the first engagement surface away from the planar portion.

13. The operating mechanism of claim 1, further comprising a second rib coupled to the rotating member, wherein the rib is a first rib and the second engagement surface extends between the first rib and the second rib.

14. The operating mechanism of claim 13, wherein the first rib and the second rib extend substantially parallel to the axis.

15. The operating mechanism of claim 14, wherein the first rib and the second rib each have a flat plate shape extending radially relative to the axis.

16. An image forming apparatus, comprising:

a photosensitive body configured to carry an electrostatic latent image;

an exposure head configured to form the electrostatic latent image on the photosensitive body; and a lifting mechanism, including:

a translating member coupled to the exposure head such that movement of the translating member along an axis controls a distance between the photosensitive body and the exposure head, the translating member including a protrusion defining a first engagement surface;

a control member coupled to the translating member and defining a second engagement surface, wherein the second engagement surface is configured to engage the first engagement surface such that movement of the protrusion relative to the control member in a direction perpendicular to the axis causes a corresponding movement of the translating member along the axis; and a rib coupled to the control member and configured to resist deformation of the control member caused by engagement between the protrusion and the second engagement surface.

17. The image forming apparatus of claim 16, wherein the control member defines an aperture that receives the translating member to rotatably couple the translating member to the control member, such that the protrusion is configured to rotate about the axis to cause movement of the translating member along the axis.

18. The image forming apparatus of claim 16, wherein the engagement between the protrusion and the second engagement surface is configured to resist movement of the exposure head toward the photosensitive body.

19. The image forming apparatus of claim 16, wherein the lifting mechanism further includes:

a sliding link coupled to the translating member and configured to move along the axis in conjunction with the movement of the translating member along the axis; and a linkage assembly coupled to the sliding link and the exposure head and configured to convert a displacement of the sliding link along the axis into a displacement of the exposure head perpendicular to the axis.

20. An exposure unit for forming an electrostatic latent image on a photosensitive body of an image forming apparatus, the exposure unit comprising:

a frame;

an exposure head configured to emit light to form the electrostatic latent image;

a first link slidably coupled to the frame;

a biasing member coupled to the frame and the first link and configured to bias the first link to move in a first direction;

a second link coupled to the first link and the exposure head such that movement of the first link in the first direction causes the exposure head to move in a second direction perpendicular to the first direction;

a translating member coupled to the first link and defining a first engagement surface;

a control member coupled to the frame and rotatably and translatably coupled to the translating member, the control member defining a second engagement surface having an inclined portion; and a rib coupled to the control member and configured to resist deformation of the control member caused by engagement between the first engagement surface and the second engagement surface, wherein:

the biasing member biases the first engagement surface into engagement with the second engagement surface; and the inclined portion is oriented such that rotation of the translating member relative to the control member causes a corresponding movement of the translating member and the first link in a third direction opposite the first direction.

* * * * *